US008469084B2

(12) United States Patent
Clark et al.

(10) Patent No.: US 8,469,084 B2
(45) Date of Patent: Jun. 25, 2013

(54) WIRELESS TRANSFER OF POWER AND DATA BETWEEN A MOTHER WELLBORE AND A LATERAL WELLBORE

(75) Inventors: Brian Clark, Sugar Land, TX (US); Thomas H. Zimmerman, Houston, TX (US); Kuo-Chiang Chen, Sugar Land, TX (US); Emmanuel Rioufol, Houston, TX (US); John Algeroy, Houston, TX (US); Patrick McKinley, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 290 days.

(21) Appl. No.: 12/789,613

(22) Filed: May 28, 2010

(65) Prior Publication Data

US 2011/0011580 A1 Jan. 20, 2011

Related U.S. Application Data

(60) Provisional application No. 61/225,611, filed on Jul. 15, 2009.

(51) Int. Cl.
*E21B 17/003* (2006.01)

(52) U.S. Cl.
USPC ..... 166/65.1; 340/854.6; 340/854.8

(58) Field of Classification Search
USPC ..... 340/854.6, 854.8; 166/65.1
See application file for complete search history.

(56) References Cited

U.S. PATENT DOCUMENTS

| | | | | |
|---|---|---|---|---|
| 6,577,244 | B1 | 6/2003 | Clark et al. | |
| 6,614,229 | B1 | 9/2003 | Clark et al. | |
| 6,727,827 | B1 | 4/2004 | Edwards et al. | |
| 6,863,127 | B2 * | 3/2005 | Clark et al. | 166/250.01 |
| 6,903,660 | B2 | 6/2005 | Clark et al. | |
| 6,975,243 | B2 | 12/2005 | Clark et al. | |
| 7,187,297 | B2 | 3/2007 | Clark et al. | |
| 7,380,597 | B2 | 6/2008 | Edwards et al. | |
| 2010/0231411 | A1 * | 9/2010 | Tubel | 340/854.3 |

* cited by examiner

*Primary Examiner* — Arnold Kinkead

(57) ABSTRACT

A technique enables wireless communication of signals in a well. The technique is employed for communication of power signals and/or data signals between a mother wellbore and at least one lateral wellbore. A first wireless device is positioned in a mother wellbore proximate a lateral wellbore, and a second wireless device is positioned in the lateral wellbore. The power and/or data signal is transferred wirelessly between the first and second wireless devices via magnetic fields. A plurality of the first and second wireless devices may be employed in cooperating pairs to enable communication between the mother wellbore and a plurality of lateral wellbores.

15 Claims, 25 Drawing Sheets

WIRELESS TRANSFER OF POWER AND DATA BETWEEN A MOTHER WELLBORE AND A LATERAL WELLBORE

CROSS-REFERENCE TO RELATED APPLICATION

The present document is based on and claims priority to U.S. Provisional Application Ser. No. 61/225,611, filed Jul. 15, 2009.

BACKGROUND

Modern oil well drilling technology has allowed operators to drill complex extended reach wells, horizontal wells, and multilateral wells that have lateral branches from a mother wellbore. These innovations have allowed operators to increase production from a single well many fold over traditional vertical oil wells. The so-called "MRC—Maximum Reservoir Contact" wells and "ERC—Extreme Reservoir Contact" wells" comprise a mother wellbore from which a large number of horizontal lateral wellbores are drilled. The mother wellbore and horizontal laterals penetrate the oil bearing layers and are able to drain a large areal extent of the oil reservoir. The lateral wellbores may be thousands of feet in length.

The many lateral wellbores from one mother wellbore may exploit a single oil zone, in which case they are within the same formation attached to the mother wellbore at essentially one depth. However, it is also possible to drill the laterals in two or more oil zones at different depths in the earth. In either case, the flows from the different laterals are comingled in the mother wellbore.

These types of wells not only significantly increase the rate of oil production, but can also increase the total recovery factor by reducing the pressure drop between the formation and the wellbores. By reducing the pressure drop, water underlying the oil zone is less likely to break through the oil layer and enter a wellbore. Water being generally much less viscous than oil, once water enters the well, it tends to significantly reduce the production of oil. Hence, maintaining low pressure drops over a large extent of the oil reservoir, thus maintaining oil production, can significantly improve the economics of an oil field.

As long as all of the laterals are producing oil, and none are producing much water, the well operation is efficient. However, if water enters one of the laterals, it may flood the mother wellbore and thus greatly reduce the oil flowing from the other laterals into the mother wellbore. Once this happens, the entire well may no longer be economical. Thus, it is desirable to monitor the pressure in the laterals, to monitor the flow of oil and water into each of the laterals, and to have some means of controlling the pressures and some means for reducing the water influx. For example, pressure gauges can be deployed in the mother wellbore and lateral wellbores to monitor pressures. Measuring the resistivity of the fluids in the wellbores can be used to detect water influx. Valves may be deployed in the other wellbore or laterals to choke flow or to shut flow off entirely. If sensors and valves are to be deployed in the lateral wells, then they must have a means for communication to the surface via the mother wellbore, and must have a power source to operate the sensors and valves. Wells that have downhole sensors, valves, and a communication and control system between the reservoir and the surface to monitor and enhance production are known as "intelligent wells".

Hardware that is deployed in the mother wellbore and/or in the laterals is called the "completion". The mother wellbore completion may comprise a casing or a liner cemented into the formation, or it may simply be an open borehole. The mother wellbore may also contain tubing which is run inside the casing, liner, or open hole. Packers can be used to isolate the tubing from the casing, so as to force the produced fluids to flow inside the tubing to surface. Packers can also be used in the lateral wells to isolate flow from different sections along the length of the lateral well. Valves in the lateral wells can then be used to reduce or shut-off flow from a section of the lateral that is producing too much water.

Lateral wellbores can be connected to the mother wellbore in a variety of ways with different types of junctions. Multilateral junctions are classified according to levels of increasing performance, complexity and cost, from level 1 (the simplest and least expensive) to level 6 (the most expensive but providing the greatest pressure and mechanical integrity). A level 1 junction is an openhole lateral from an openhole mother wellbore with no mechanical or hydraulic junction. This level is applicable in consolidated formations that do not require casing or liners (a well can be cased with a casing or a liner, a casing extends to the surface, while a liner does not, otherwise they serve the same function). In a level 2 junction, the mother wellbore is cased and cemented, but the lateral wellbore is open. Level 2 junctions are more common than level 1 because they offer greater flexibility and because good technology is available. Level 3 junctions have cased and cemented mother wellbores and lateral wellbores with liners, but the lateral liner is not cemented. In some level 3 multilateral completions, the lateral liner is hung-off the mother wellbore casing. This requires the very accurate placement of the lateral liner with respect to the mother wellbore. In a level 4 junction, both the mother wellbore casing and the lateral liners are cemented. A level 5 junction provides pressure and mechanical integrity using packers and tubing in the both lateral and the mother wellbores. A level 6 multilateral junction is a solid metal junction that is part of the mother wellbore casing. The level 6 junction provides the highest degree of pressure and mechanical integrity.

Providing both power and communications across the different level junctions is an unsolved problem. Some companies provide wireless communications across a junction, but power has to be supplied either by a turbine located in the lateral, or by vibration harvesting (e.g. using piezoelectric crystals) and a rechargeable battery located in the lateral. Alternatively, the completion in the lateral could be provided with long life batteries which are periodically replaced. In each of the above scenarios, however, there are serious drawbacks. A turbine or vibration harvester requires significant flow in the lateral, and may even create a pressure drop that reduces oil production. Because turbines have moving parts, they would have long term reliability and maintenance issues. Rechargeable batteries are notoriously unreliable in a high temperature environment, and would need to be replaced periodically, as would conventional downhole batteries. Well intervention to replace batteries is a very expensive operation, which typically requires production from the entire well to be stopped during the operations. Interrupting production may even result in damaging the formation so that the production rate is permanently reduced.

SUMMARY

In general, the present invention provides a system and methodology for wirelessly transferring signals, e.g. power and/or data, in a well. The technique is employed for communication between a mother wellbore and at least one lateral wellbore. A first wireless device is positioned in the mother wellbore proximate a lateral wellbore, and a second wireless device is positioned in the lateral wellbore. The power and/or data signal is transferred wirelessly between the first and second wireless devices via magnetic fields. A plurality of the first and second wireless devices may be employed in cooperating pairs to enable communication between the mother wellbore and a plurality of lateral wellbores.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention generally involves a system and methodology related to communicating signals wirelessly in a well environment. In the embodiments described herein, power and/or data signals are transmitted wirelessly from one region of a well to another region of the well. For example, power may be transmitted wirelessly from a mother wellbore to one or more lateral wellbores which extend from the mother wellbore. Similarly, data signals, such as telemetry signals, also may be transmitted wirelessly from the mother wellbore to the one or more lateral wellbores. Transfer of data signals also may be from the one or more lateral wellbores to the mother wellbore for relay to a desired collection location, such as a surface location.

According to one embodiment, an electrical cable or cables may be run downhole in the mother wellbore to provide electrical power to desired regions of the wellbore, such as regions proximate the one or more lateral wellbores. The electrical cables may be attached to well strings, e.g. tubing, deployed downhole in the mother wellbore which typically extends down into a subterranean region from a surface location. Because the electrical power is delivered from a surface location and electrical power is transferred to lateral wellbores or other regions wirelessly, the need for batteries to power components in the lateral wellbores is obviated. Furthermore, being able to transmit power wirelessly across junctions between wellbores provides operational benefits related to procedures employed in drilling and completing a multilateral well, especially for the more common level 1, 2 and 3 junctions between the mother wellbore and lateral wellbores.

Figure 1:
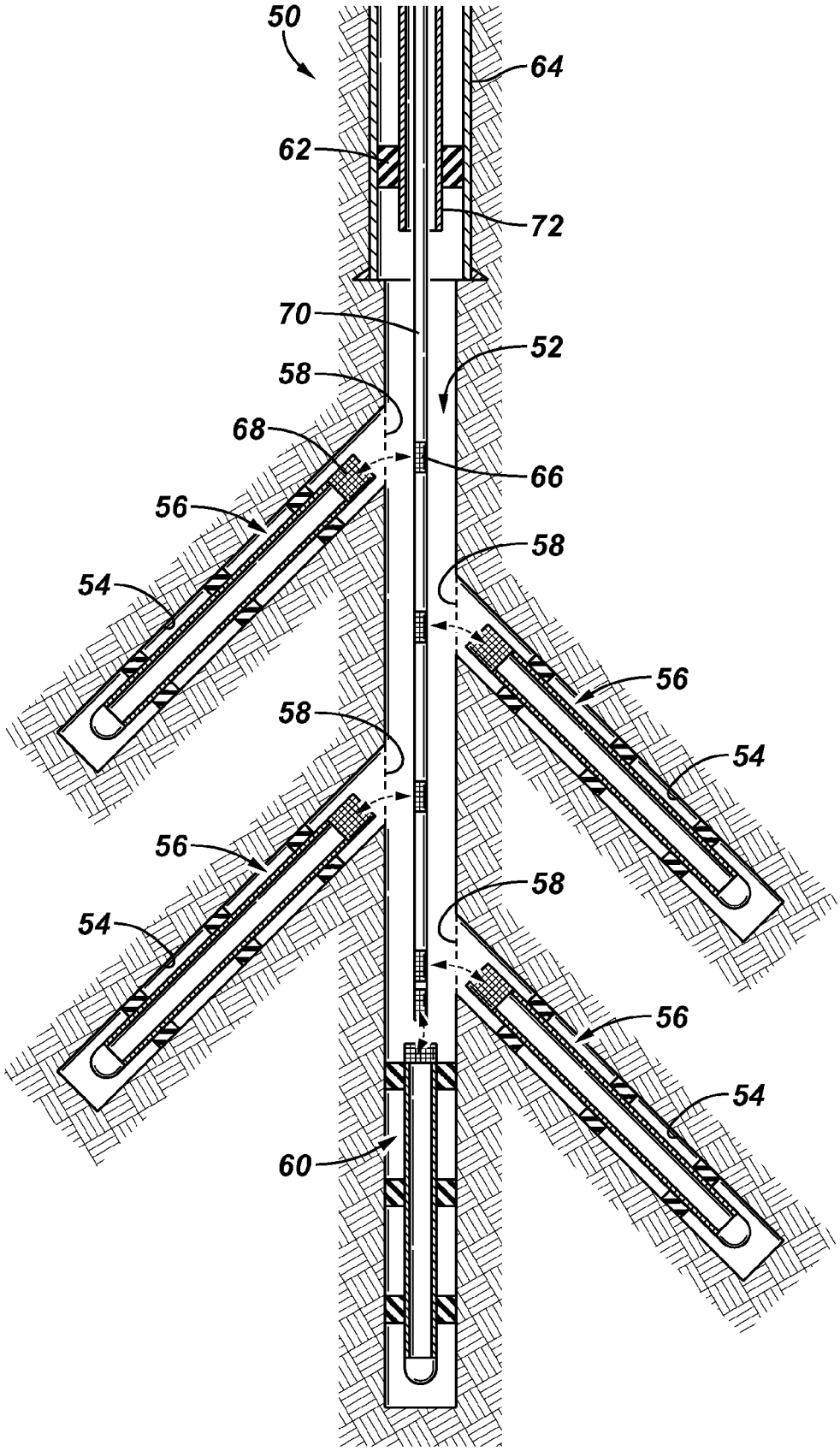
FIG. 1 is cross-sectional side view of a level 1 multilateral well with open mother borehole and wireless power and communication to lateral wellbores via a carrier in which flow enters tubing below a production packer, according to an embodiment of the present invention.

One such procedure is better understood with reference to a multilateral well 50 illustrated in FIG. 1 in which a mother wellbore 52 is not cased and at least one lateral wellbore 54, e.g. a plurality of lateral wellbores, extends from the mother wellbore 50. To drill the lateral wellbores 54, a whipstock may be set in the open hole of the mother wellbore 52. The whipstock is used to direct the drill bit into the formation at the appropriate direction and at the desired depth for each lateral wellbore 54. The whipstock can be held in place using openhole packers. The initial deviation between the lateral wellbore and the mother wellbore may be only a few degrees. For example, a junction angle of 2° is not uncommon. After a few tens of feet, the angle between the lateral wellbore and the mother wellbore may increase rapidly using a directional drilling system (e.g. with a mud motor and bent sub).

After each lateral wellbore drilling is completed, a lateral completion 56 may be run into the lateral wellbore 54. It can be difficult to accurately place the lateral completion 56 such that its top is in precise alignment with an opening 58 in the mother wellbore. Typical placement errors can be substantial, e.g. 10 feet or more. It is sometimes difficult to run the lateral completion all the way into the lateral borehole 54 due to friction in the lateral wellbore, cuttings beds, or even hole collapse. A completion 60 also may be positioned in the lower end of mother wellbore 52, as illustrated. After all of the lateral wellbores 54 have been drilled and the lateral completions 56 run into the well 50, a tubing string may be run into the mother wellbore. A packer 62, e.g. a production packer, may be deployed in an upper section of casing 64 to hydraulically isolate the upper section of casing from the produced fluids.

Figure 2:
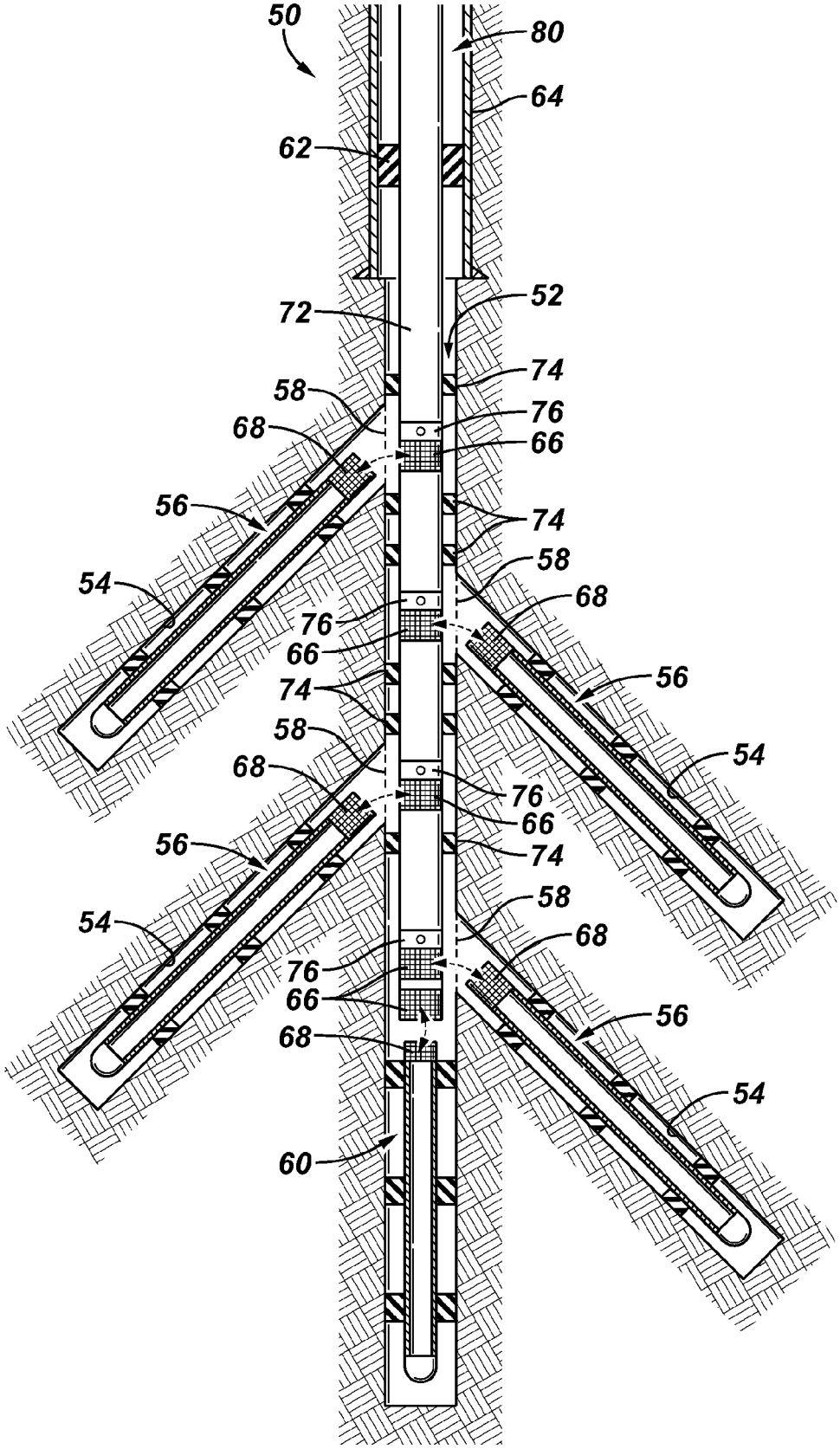
FIG. 2 is a cross-sectional side view of a level 1 multilateral well with open mother borehole and wireless power and communication to lateral wellbores via tubing, wherein flow from each lateral wellbore is isolated via packers and in which flow enters the tubing through a device such as perforated tubing, a sliding sleeve or a surface controlled flow control valve, according to an alternate embodiment of the present invention.

In FIG. 1, the level 1 multilateral well has an open mother borehole 52. A first wireless device 66 is deployed in the mother wellbore 52 proximate each lateral wellbore 54, and a second wireless device 68 is deployed in each lateral wellbore 54 on, for example, a proximate end of the lateral completion 56. In the example illustrated in FIG. 1, a plurality of first wireless devices 66 is deployed along the mother wellbore 52 for cooperation with corresponding second wireless devices 68 in each of the lateral wellbores and 54. The first and second wireless devices 66, 68 cooperate in pairs to provide wireless power and/or wireless communication of data between the mother wellbore 52 and the one or more lateral wellbores 54. The first wireless devices 66 may be deployed downhole in the mother wellbore 52 via a carrier 70, which can be a rod or small diameter tubing. In this embodiment, the fluids flow into a production tubing 72 that ends just below the production packer 62. In FIG. 2, the level 1 multilateral well also has an open mother borehole 52 and wireless power and communication to lateral wellbores 54. However, the production tubing 72 extends down through the mother wellbore 52 to the lateral wellbores 54 and supports the first wireless devices 66. Fluids flow from each lateral wellbore 54, but the flow from the individual laterals is isolated using isolation packers 74. The fluids enter the production tubing 72 through an appropriate tubing opening device 76, such as a perforated tubing, a sliding sleeve, or a surface controlled flow control valve.

Figure 3:
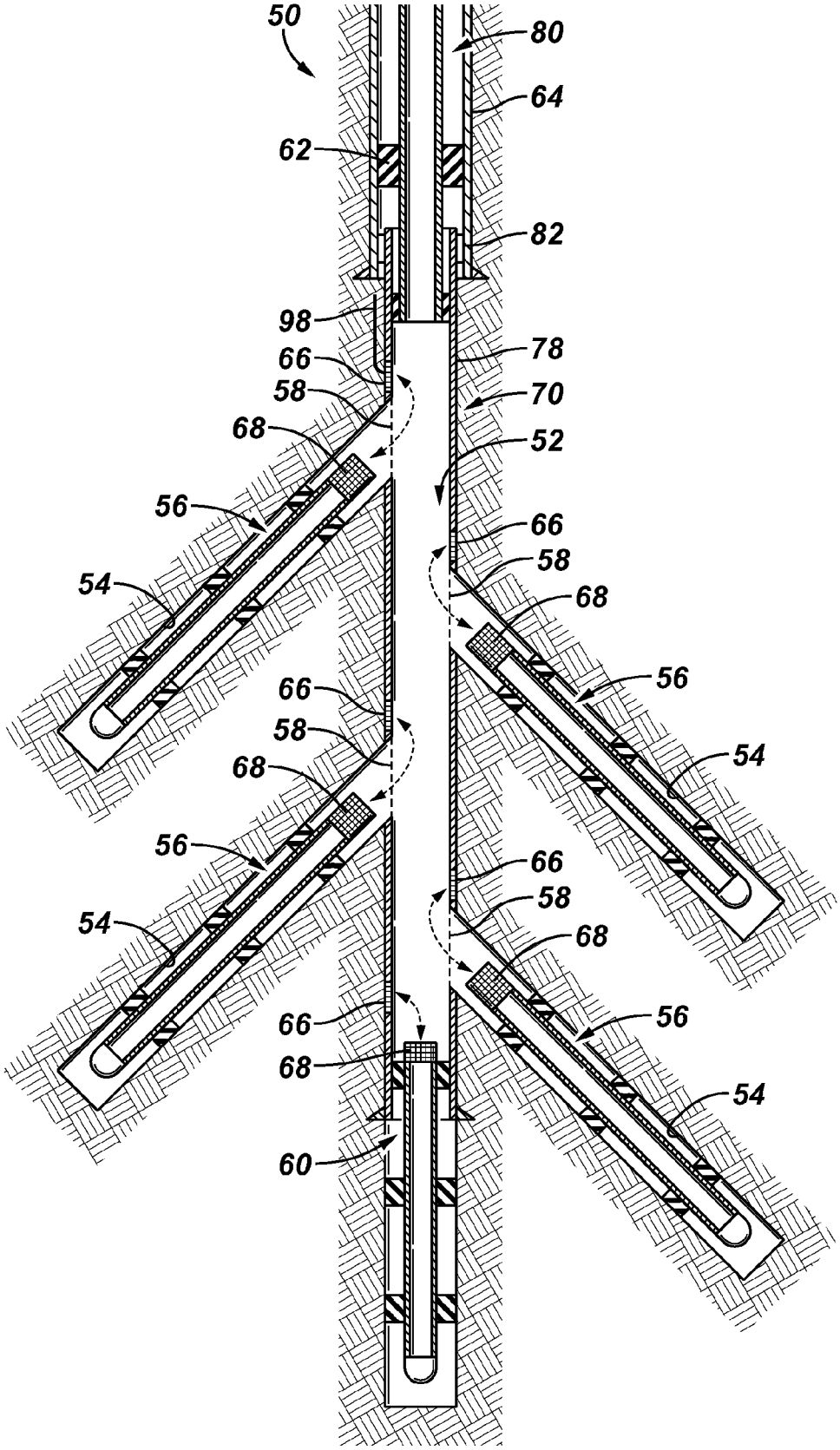
FIG. 3 is a cross-sectional side view of a level 2 multilateral well with a cased mother borehole and wireless power and communication to lateral wellbores in which the an upper completion communicates through an inductive coupler and wireless transmitter installed on the casing, according to an alternate embodiment of the present invention.

Referring to FIG. 3, the multilateral well 50 is illustrated as having level 2 junctions. After drilling the mother wellbore 52, a mother wellbore casing/liner 78 is hung from casing 64 and cemented into the formation. The liner 78 serves to support and deploy first wireless devices 66 along the mother wellbore. In this example, a whipstock is set inside the liner 78 at the appropriate depth and appropriate angle to drill each lateral borehole 54. A special milling drill bit is used to cut an opening in the casing. The resulting window may be 10 feet long and over 6 inches wide. Again the initial angle between the mother wellbore 52 and each lateral wellbore 54 is small, on the order of a few degrees. The drill string is tripped out of the borehole and the milling drill bit is replaced with a normal drill bit. After the lateral borehole has been drilled, the drill string is tripped out and the lateral completion is run into place. As with the level 1 completion, the level 2 lateral completion cannot be accurately placed with respect to the milled window.

Figure 4:
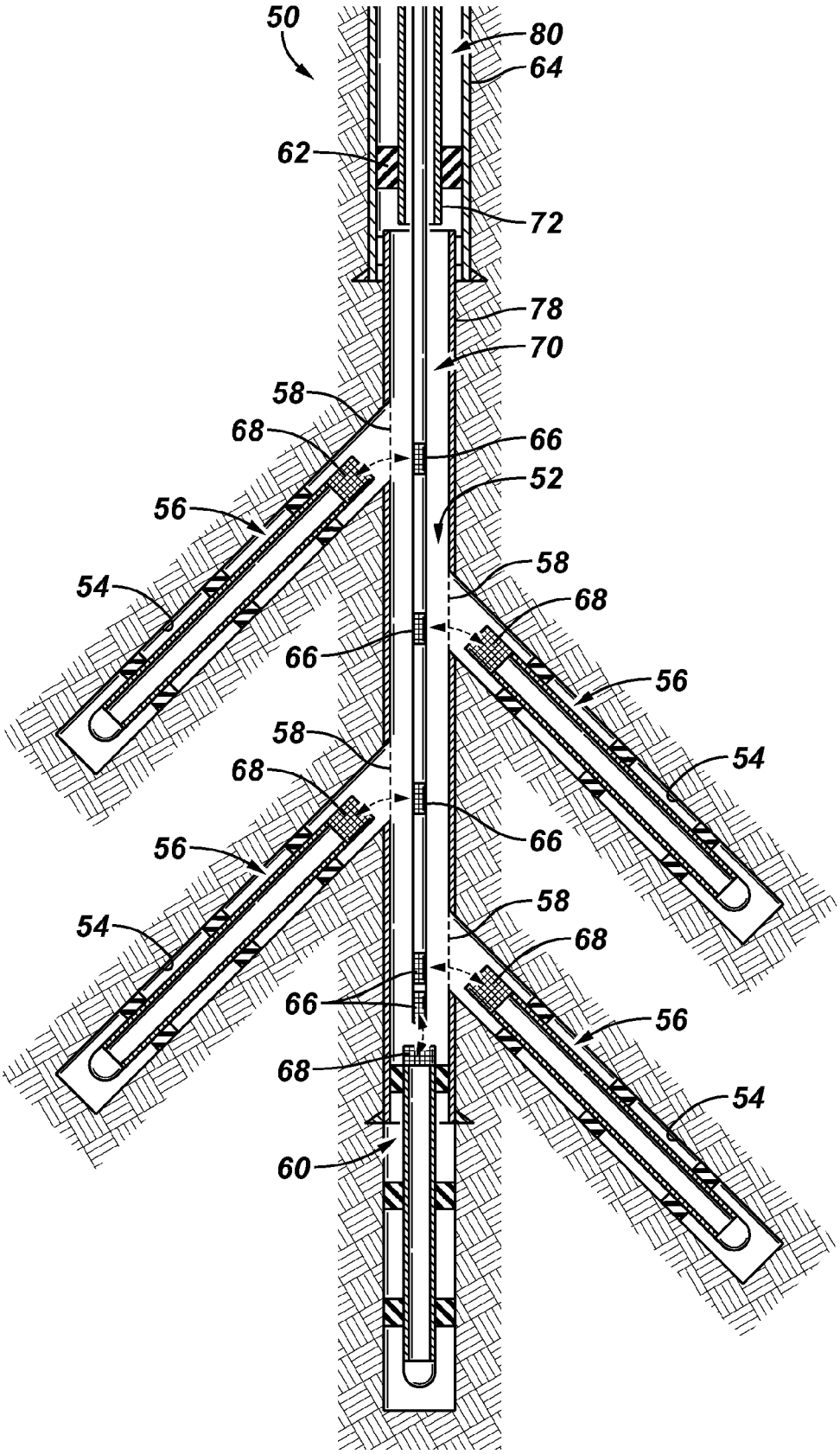
FIG. 4 is a cross-sectional side view of a level 2 multilateral well with a cased mother borehole and wireless power and communication to lateral wellbores in which a wireless transmitter is installed on a carrier, and in which production from laterals located outside of the carrier enters the tubing immediately below the production packer, according to an alternate embodiment of the present invention.
Figure 5:
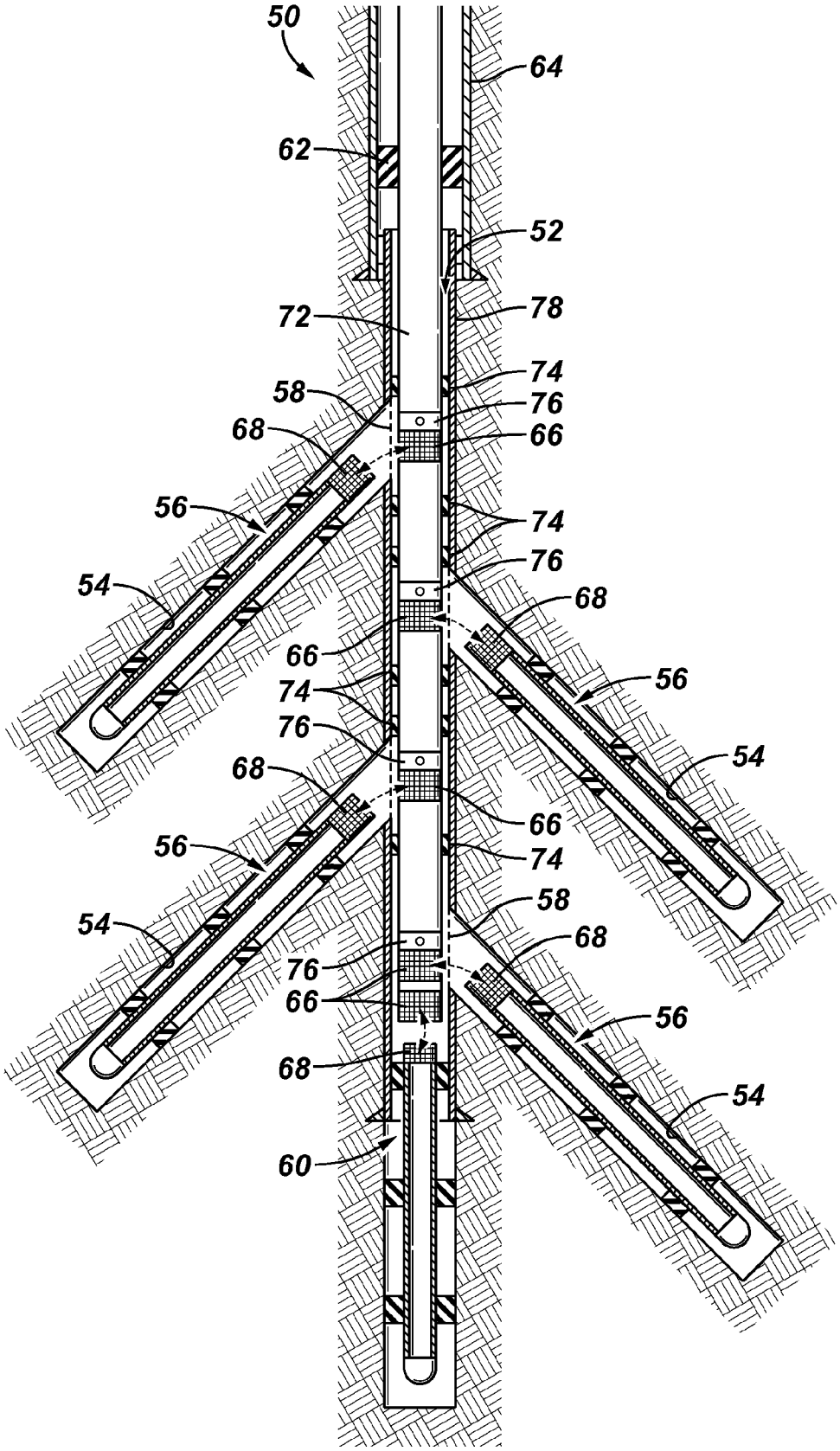
FIG. 5 is a cross-sectional side view of a level 2 multilateral well with cased mother borehole and wireless power and communication to laterals via tubing, wherein flow is from each lateral isolated via packers and wherein flow enters the tubing through a device such as perforated tubing, a sliding sleeve, or a surface controlled flow control valve, according to an alternate embodiment of the present invention.

In FIG. 3, a level 2 multilateral well is shown with a cased mother wellbore 52, via liner 78, and wireless power and communication is provided to each lateral wellbore 54. Communication from an upper completion 80 is transferred to liner 78 via an inductive coupler 82 which serves as a wireless transmitter installed on the casing. In FIG. 4, an alternative version of a level 2 multilateral well 50 with cased mother borehole 52 and wireless power and communication to lateral wellbores 54 is illustrated. In this embodiment, the first wireless devices 66, e.g. wireless transmitters are installed on the carrier 70, e.g. a small diameter tubing or rod. The production from the different lateral wellbores 54 flows outside of the carrier 70, and enters the production tubing 72 immediately below the production packer 62. Another variation of a level 2 multilateral well 50 is illustrated in FIG. 5 with cased mother borehole 52 and wireless power and communication to lateral wellbores. In this embodiment, the wireless devices 66, e.g. wireless transmitters, reside on the production tubing 72 which extends down into the mother wellbore 52 within the liner/casing 78. Fluids flowing from each lateral wellbore 54 are isolated using isolation packers 74. Flow from each lateral wellbore 54 can enter the production tubing through the appropriate tubing opening device 76, e.g. a perforated tubing, a sliding sleeve, or a surface controlled flow control valve.

The process of creating a level 3 junction is similar to that for a level 2 junction, except that a liner is run into each lateral wellbore 54 before running the lateral completion 56 that contains sensors and/or other devices. There is one variation where the upper end of the lateral liner has a special feature which allows the lateral liner to hang off of the cased mother wellbore 52. The window for the junction may be milled after the mother wellbore 52 has been cased, or the mother wellbore casing 78 may have had the window pre-milled before it was run into the well.

Figure 6:
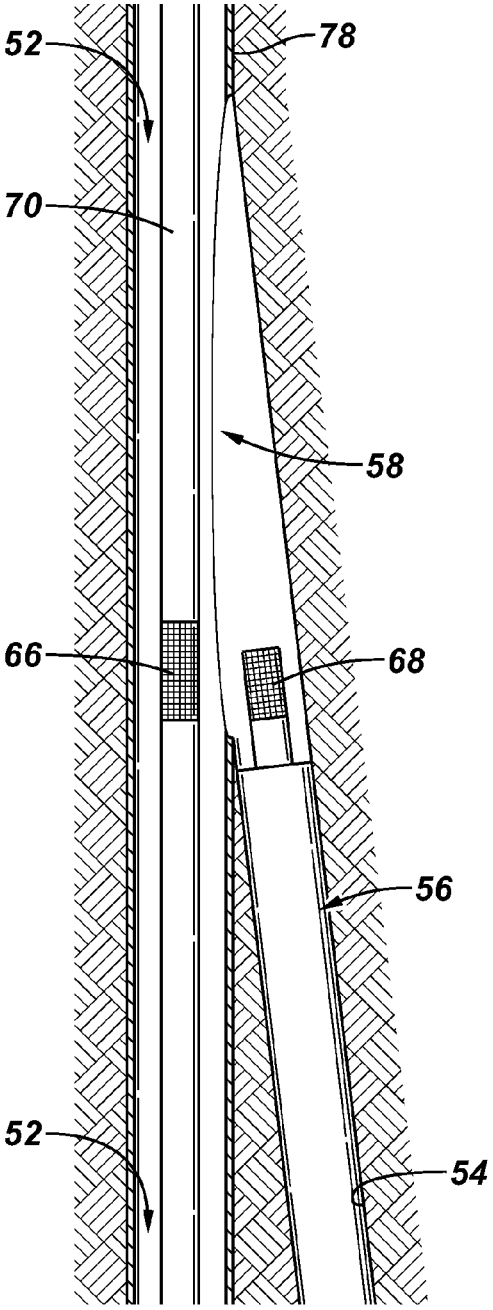
FIG. 6 is a cross-sectional side view of a lateral completion that has landed close to the bottom of the milled window, according to an embodiment of the present invention.
Figure 7:
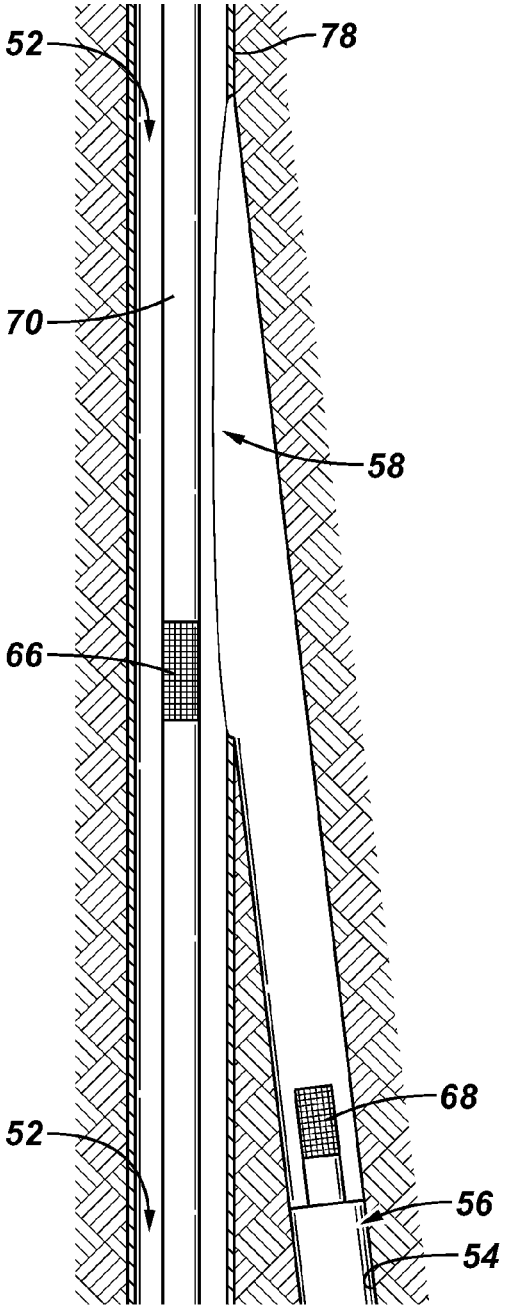
FIG. 7 is a cross-sectional side view of a lateral completion that has landed several feet below the milled window, according to an alternate embodiment of the present invention.

Because of the uncertainty in placing each lateral completion 56 with respect to the opening 58 from the mother wellbore 52, power transmission across the junction is difficult. The top of the lateral completion 56 might be level with the bottom of the window 58, as illustrated in FIG. 6, or the top of the lateral completion 56 may be several feet lower, as illustrated in FIG. 7. Wireless power transfer may be achieved with wireless devices 66, 68, e.g. coils or inductive couplers, provided the distance is small between the wireless devices, e.g. between the coils or the two halves of an inductive coupler. Efficient coupling between coils that are separated by several feet is exceptionally challenging. In FIGS. 6 and 7, the first wireless device 66, e.g. first coil, is located in the opening 58, which in this example is a milled window in the casing 78 of the mother wellbore 52. The second wireless device 68, e.g. second coil, is located in the top portion of the lateral completion 56. The large opening of the milled window allows the magnetic field from first coil 66 to escape the cased well. However, if the lateral completion 56 cannot be accurately placed with respect to the window 58 (and hence close to first coil 66), then the coupling efficiency may be poor between the two coils. Therefore, some embodiments of this invention may provide means of efficiently coupling energy from the mother wellbore 52 to the lateral wellbore 54 by achieving a close proximity of the wireless devices 66, 68, e.g. coils.

Figure 8:
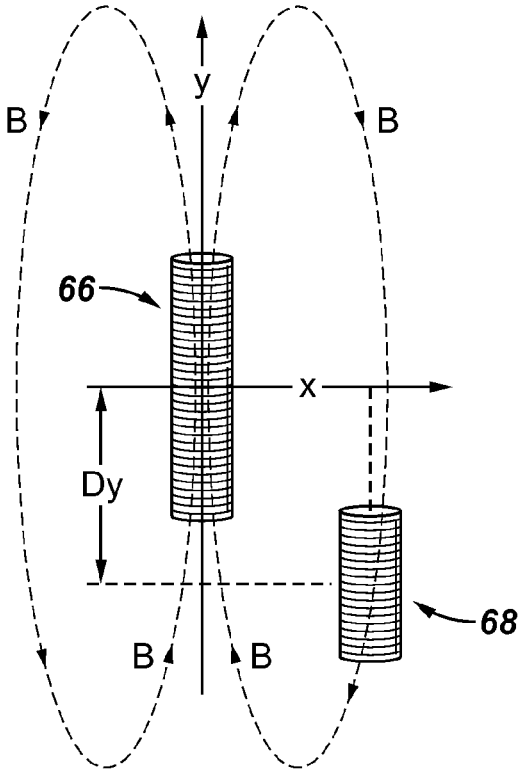
FIG. 8 is a partial schematic showing the geometry for two coils, each aligned in the y-direction and separated in the x-direction, according to another embodiment of the present invention.

Referring to FIG. 8, an example is illustrated with two wireless devices 66, 68 in the form of wire coils which are aligned with the y-direction, corresponding to the illustrations in FIGS. 6 and 7. In this example, coil 66 is 100 cm long and centered at (x, y)=(0,0) while coil 68 is 50 meter long and centered at (x, y)=(26 cm, Dy). An x position of 26 cm was chosen because this is the center-center distance between a 12 inch borehole and an 8½ inch borehole, i.e. 10¼ inches or 26 cm. Coil 66 is driven with an alternating current which produces an alternating magnetic field $\vec{B}$, which in turn produces an induced EMF in coil 68. Hence, coil 66 can be used to transmit power to coil 68, but the power efficiency is affected by the distance between the two coils.

Figure 9:
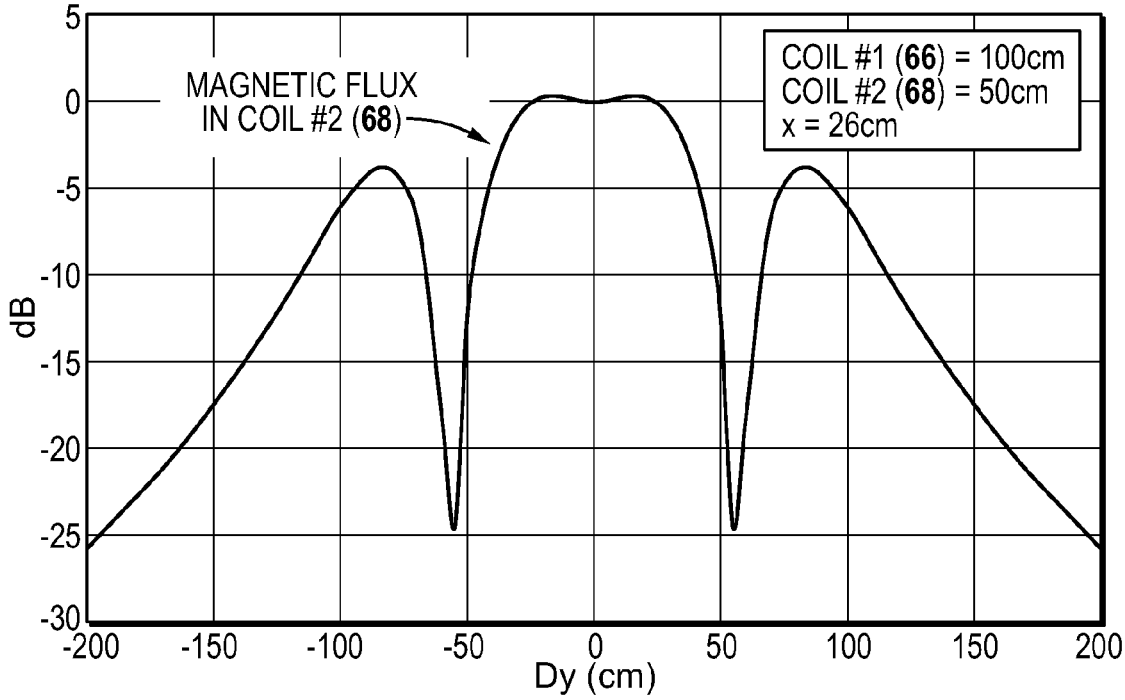
FIG. 9 is a graphical representation of relative signal strength versus displacement in the y-direction, according to an embodiment of the present invention.

FIG. 9 illustrates a graphical example of magnetic flux in coil 68 as a function of axial position (Dy)) for x=26 cm. The values plotted in FIG. 9 are normalized to 0 dB at Dy=0. There is no decrease in the magnetic flux in coil 68 for $|Dy| \leqq 25$ cm. At Dy=±37 cm, the magnetic flux decreases by 3 dB, and at Dy=±43 cm the decrease is 6 dB. At Dy=±55 cm, the magnetic flux goes through zero and then changes sign as |Dy| increases. Hence, for maximum efficiency, the relative position of the two coils along the y-direction should be less than ±25 cm. However, landing the lateral completion with this degree of accuracy will be very difficult. If the coils are misaligned by even 50 cm, then little power can be transferred from coil 66 to coil 68. Hence, techniques for achieving close alignment of the two coils affect the efficient power transfer from the mother wellbore 52 to each lateral wellbore 54.

Figure 10:
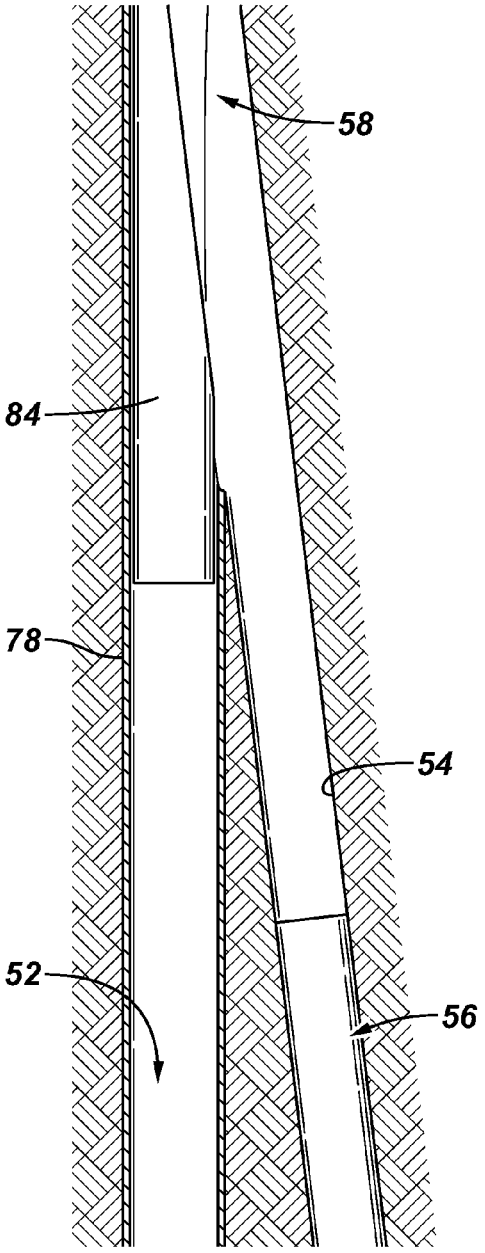
FIG. 10 is a cross-sectional side view of a lateral completion landed in a bore hole, according to another embodiment of the present invention.
Figure 11:
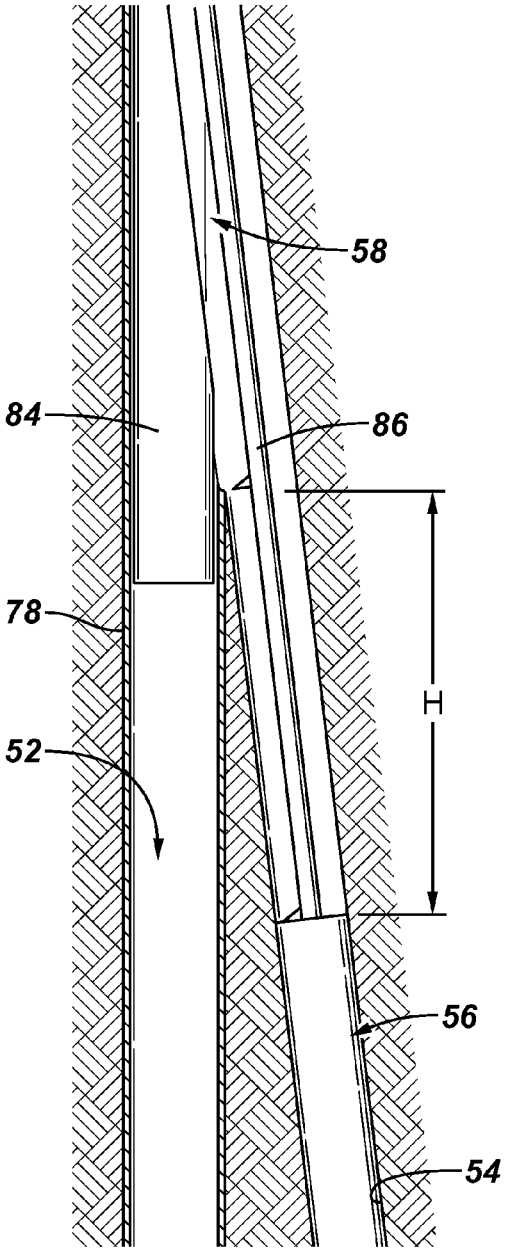
FIG. 11 is a cross-sectional side view of measuring the position of a lateral completion relative to a milled window, according to another embodiment of the present invention.

One method for positioning the two wireless devices 66, 68, e.g. wireless coils, is illustrated in FIGS. 10-13 for a level 2 junction. In FIG. 10, a whipstock 84 used to drill the lateral borehole 54 remains in place in the mother wellbore casing 78. In this example, the lateral completion 56 has been run into the lateral wellbore 54, but the top of the lateral completion 56 has landed several feet below the bottom of the milled window 58. In FIG. 11, a gauge 86 has been run into the lateral wellbore 54 to measure the distance between the lateral completion 56 and the milled window 58. The gauge 86 can be run on, for example, a wireline cable or coiled tubing and may be mechanical or electrical in nature. After the distance (H) between the top of the lateral completion 56 and the milled window 58 has been determined, the gauge 86 is withdrawn.

Figure 12:
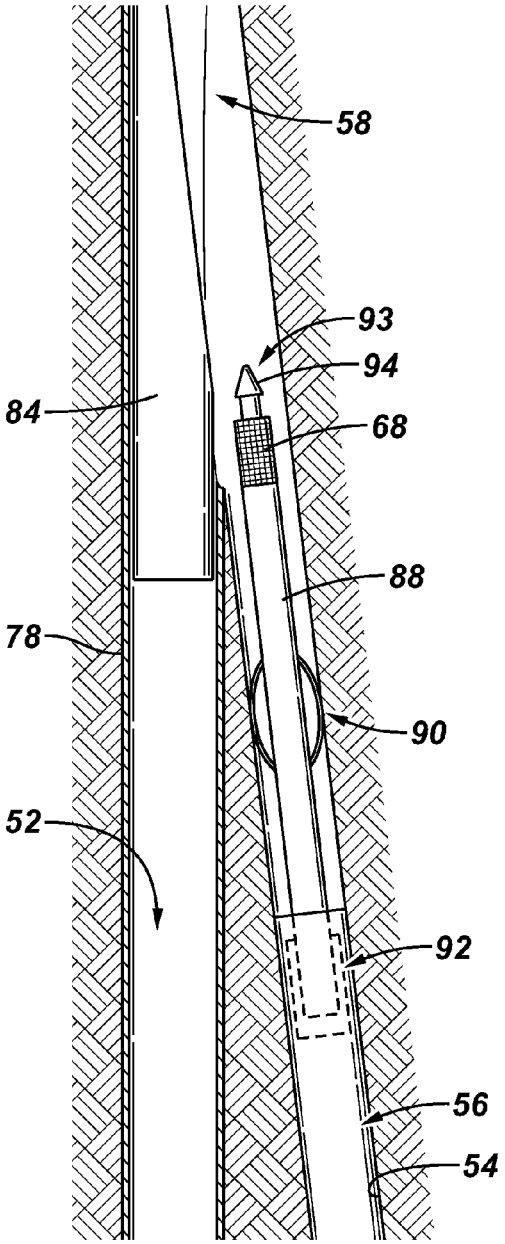
FIG. 12 is a cross-sectional side view of a lateral wellbore coil run into a lateral completion, according to another embodiment of the present invention.

Referring to FIG. 12, the second coil 68 is coupled with an extender 88 which corrects for the distance H between the top of the lateral completion 56 and the milled window 58. The length of the extender 88 is adjusted/chosen such that coil 68 resides opposite the opening of the milled window 58. By way of example, the extender 88 may comprise a non-magnetic tube (e.g. stainless steel) containing wires combined with one or more centralizers 90 and an electrical or magnetic connection 92 at its lower end. The electrical connection 92 may be a wet-stab connector that can be assembled in a fluid environment, or it may be an inductive coupler. This provides a suitable connection to the electronics and sensors in the lateral completion 56. In addition, the coil 68 and extender 88 may be formed as an assembly 93 having a fishing head 94 which allows it to latch into a fishing tool. The assembly 93 comprising coil 68, extender 88, and at least a portion of connection 92 may be made-up at the surface after the distance H has been determined. Alternatively, a selection of different length assemblies may be brought to the wellsite and the one with the appropriate length deployed downhole. Coil 68 and the extender 88 may be run into the lateral wellbore using wireline cable or coiled tubing and a fishing tool. Once the assembly 93 is seated into the connection, the fishing tool releases the assembly and is removed from the wellbore.

Figure 13:
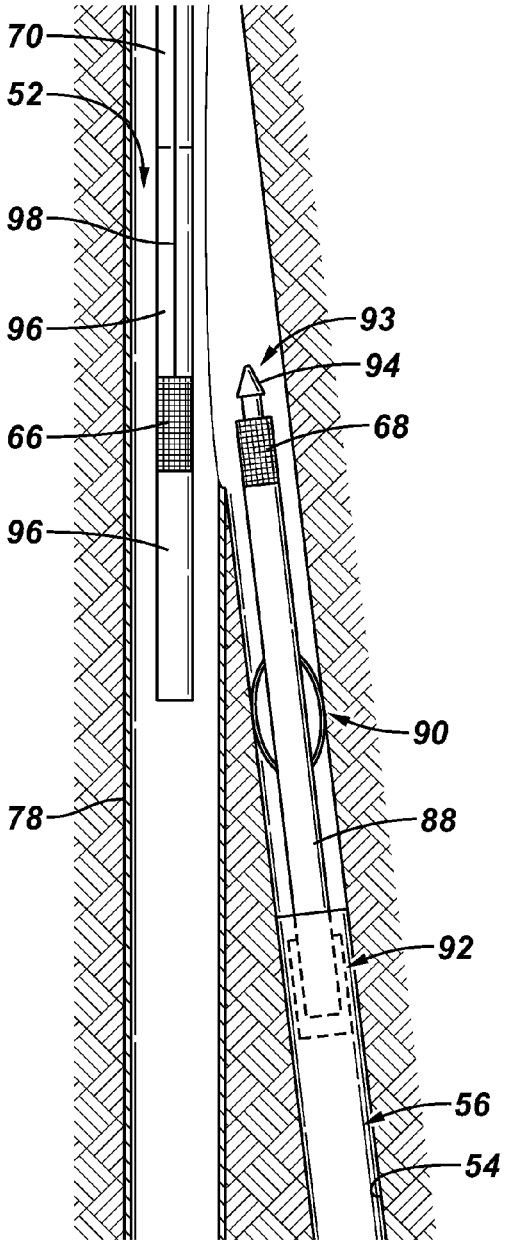
FIG. 13 is a cross-sectional side view in which a whipstock has been removed and a mother wellbore coil is run into the mother wellbore, according to another embodiment of the present invention.
Figure 14:
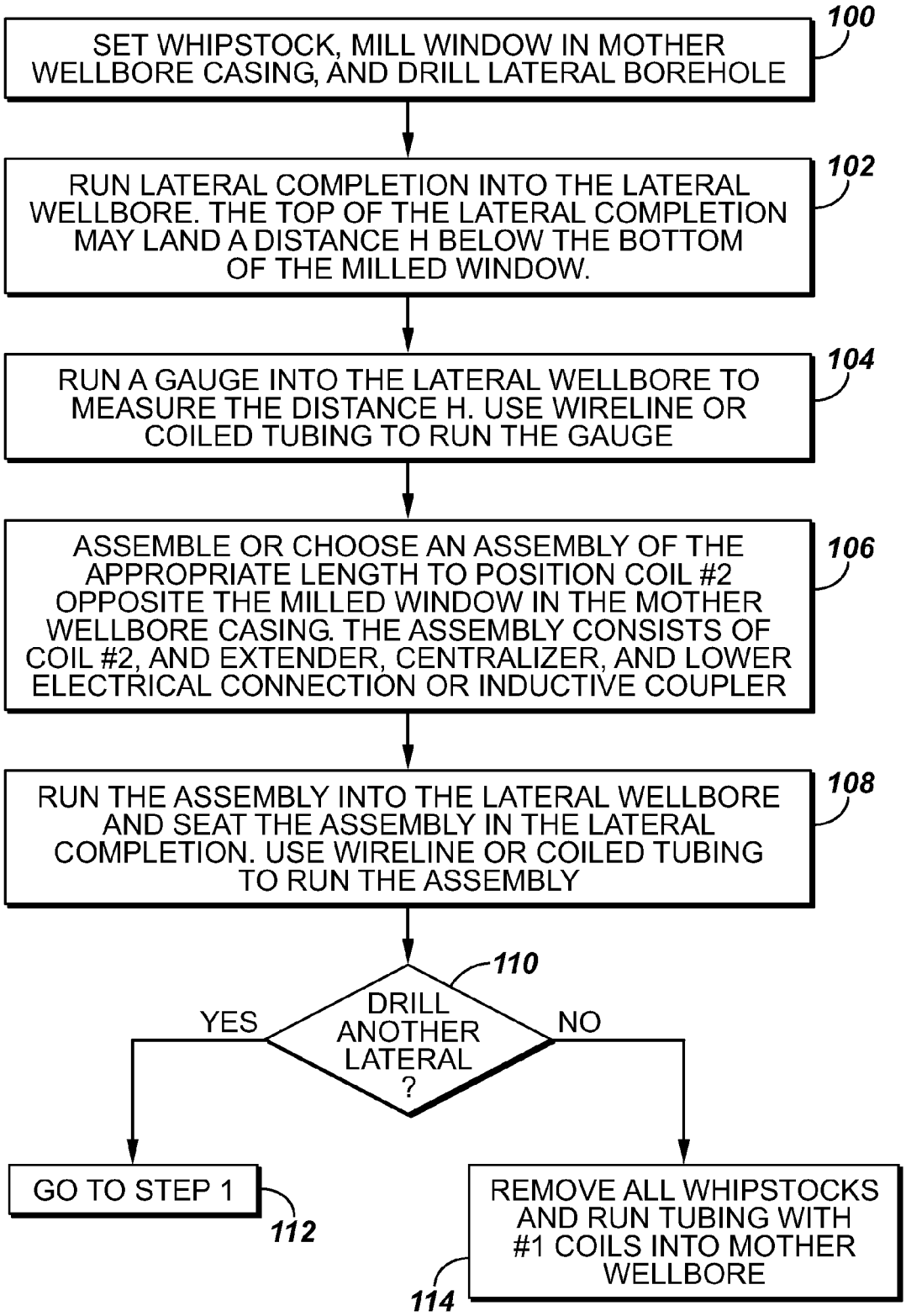
FIG. 14 is a flowchart for positioning the two coils using an extension, according to another embodiment of the present invention.

At this stage, if there are additional laterals to be drilled, the whipstock 84 is placed at the next location (e.g. higher in the mother wellbore 52). Again, a window 58 is milled in the casing 78, and the new lateral wellbore 54 is drilled. The same steps are followed as described above with reference to FIGS. 10-12. Once all of the lateral wellbores 54 have been drilled, the lateral completions 56 have been landed, all coils 68 and extenders 88 have been placed, and all whipstocks 84 have been removed, carrier 70, e.g. tubing, is run in the mother wellbore 52, as illustrated in FIG. 13. The carrier/tubing 70 has coils 66 mounted so as to land aligned with the coils 68 of corresponding lateral wellbores 54. The tubing 70 may have sections made of nonmagnetic stainless steel 96 near the coil 66. In this embodiment, the tubing 70 also carries a communication line 98, such as a power supply line and/or data communication line, which connects the coils 66 to the surface to enable transfer of power and communications with the lateral completions 56. If carrier/tubing 70 is not required to carry fluids, then the coils 66 may be mounted on other types of carriers, such as metal or fiberglass rods. Depending on the manner in which coils 66 are deployed, communication line 98 may be routed a long a number of different paths Referring generally to FIG. 14, a flowchart is provided as one example of a procedure for establishing the wireless communication, as described in the embodiments above. In this example, whipstock 84 is set to enable the milling of window 58 and the drilling of lateral wellbore 54, as represented by block 100. The lateral completion 56 is then run into the lateral wellbore 54, as represented by block 102. Gauge 86 may then be run into the lateral wellbore 54 via a wireline or coiled tubing to measure the distance H between the top of the lateral completion 56 and the window 58, as represented by block 104. Once the distance H is determined, the coil assembly with an extender 88 of suitable length is selected so that the second coil 68 is adjacent the window 58, as represented by block 106. Subsequently, the assembly 93 of second coil 68, extender 88, centralizer 90, and at least a portion of the lower connection 92 may be run downhole into the lateral wellbore 54 via wireline or coiled tubing, as represented by block 108. At this stage, a determination is made as to whether additional lateral wellbores 54 are to be drilled, as represented by block 110. If another lateral wellbore is to be drilled, the procedure is repeated, as represented by block 112. However, if no other lateral wellbores are to be drilled, the whipstocks 84 are removed from the mother wellbore and the first coils 66 are deployed downhole into the mother wellbore 52, as represented by block 114.

Figure 15:
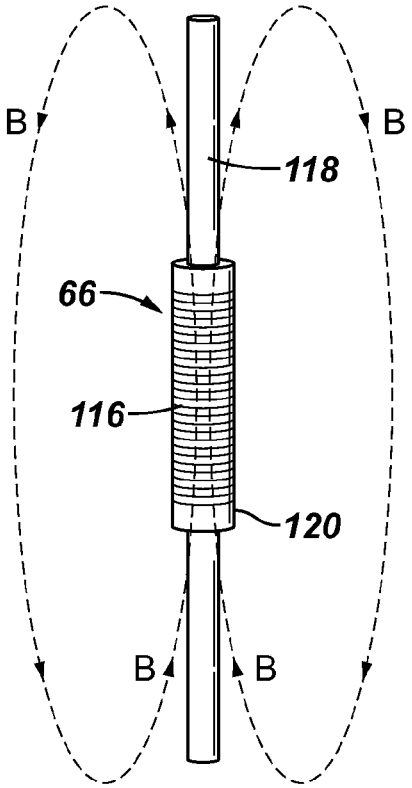
FIG. 15 is a schematic representation of a coil that can be used as a wireless device, according to another embodiment of the present invention.

Referring to FIG. 15, one embodiment of first wireless device 66 is illustrated as a first coil assembly. A wire coil 116 is mounted around a non-magnetic member 118, such as a tubing or rod, and comprises a large number of turns of wire. (Member 118 may serve as carrier 70.) A magnetic core 120 may be positioned under the wire coil 116 and around the member 118 to increase the magnetic moment of the coil. The magnetic core 118 may comprise laminated mu metal or ferrite material, depending on the operating frequency of the wireless device 66, e.g. coil. Additionally, the wire and magnetic core assembly may be potted in rubber or another waterproof material.

Figure 16:
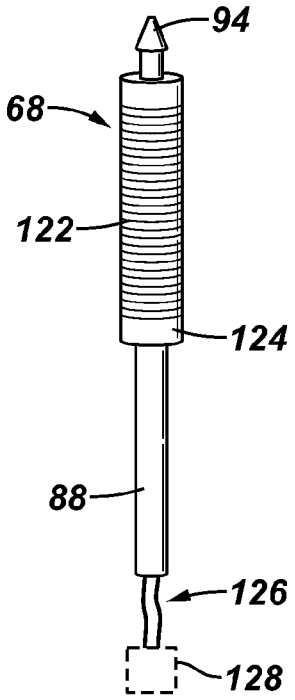
FIG. 16 is a schematic representation of a corresponding coil that can be used as a wireless device, according to another embodiment of the present invention.

Referring to FIG. 16, one embodiment of the second wireless device 68 is illustrated as a second coil assembly. In this example, the second wireless device 68 comprises a wire coil 122 having many turns of wire which may be wrapped on a magnetic core 124. The overall assembly also may comprise fishing head 94 which allows for the placement and/or removal of the assembly. In this example, the wire coil 122 and magnetic core 124 are mounted to an end of extender 88 which contains conductive wires 126. The wires 126 extend from the wire coil 122 to a device 128, e.g. lateral completion electronics, of the lateral completion 56 which is, for example, powered via the power transferred wirelessly from mother wellbore 52 to lateral wellbore 54. One or more of the wires 126 also may be used to carry data which is conveyed wirelessly between the lateral wellbore and the mother wellbore.

Figure 17:
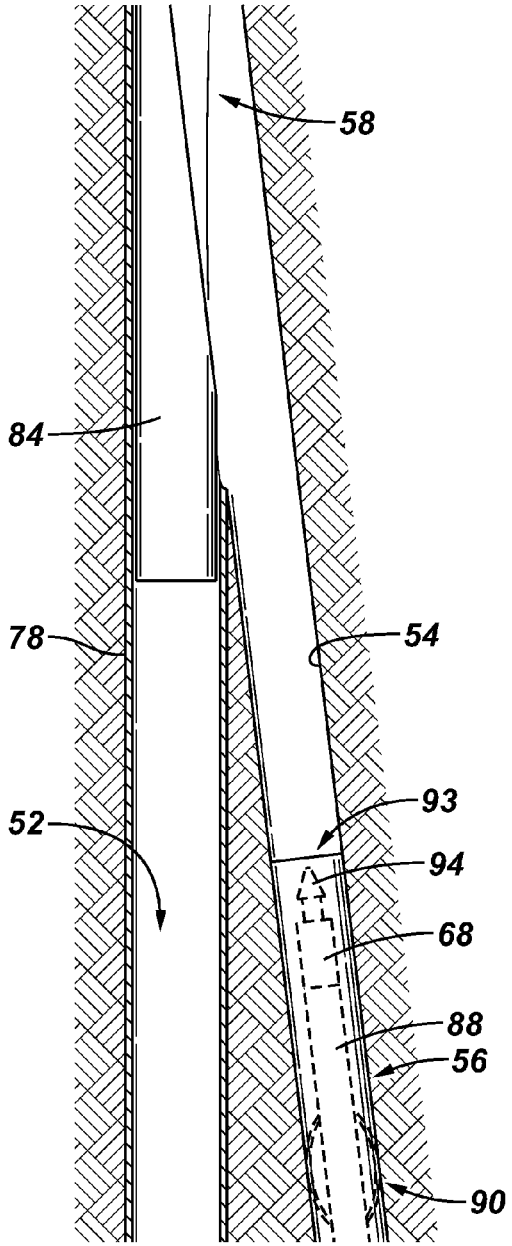
FIG. 17 is a cross-sectional side view of a coil assembly recessed inside a lateral completion during the trip into the lateral wellbore, according to another embodiment of the present invention.
Figure 18:
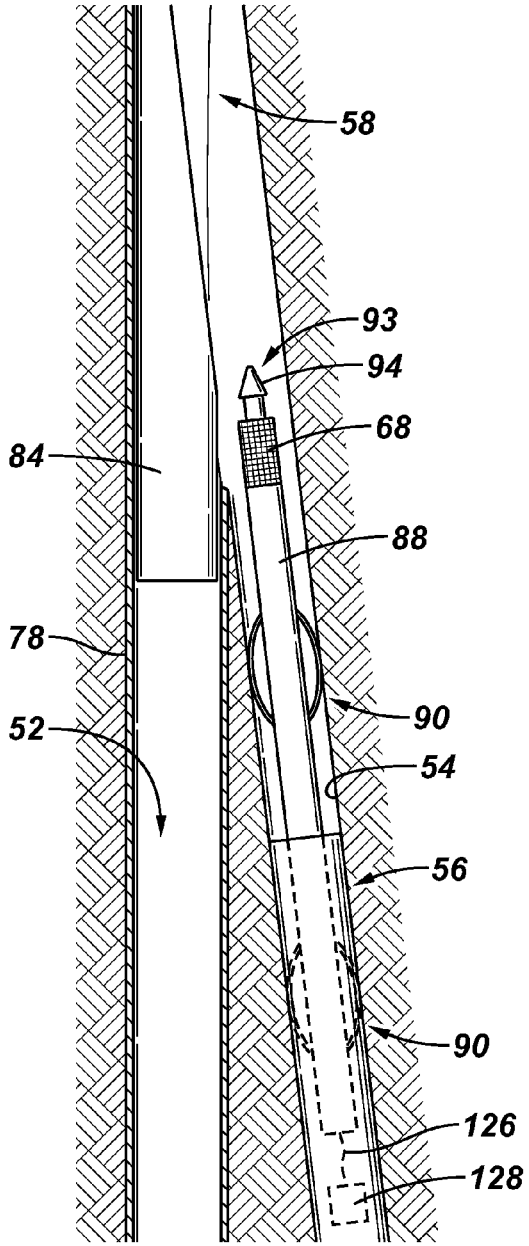
FIG. 18 is a cross-sectional side view of a coil assembly that has been pulled into position using a wireline or coiled tubing fishing tool, according to another embodiment of the present invention.

An alternative method of placing the wireless devices 66, 68, e.g. two coils, in close proximity is illustrated in FIGS. 17 and 18. In this case, the second coil 68 and its extender 88 are recessed inside the lateral completion 56 when it is run into the lateral borehole 54 (see FIG. 17) such that it is protected by the completion hardware on the trip in. The fishing head 94 on top of the coil assembly 93 allows the second coil 68 to be pulled into the correct position opposite the milled window 58. The extender tube has one or two centralizers 90. These may be bow springs or fixed diameter centralizers. In this example, the second coil 68 is connected to lateral completion electronics 128 (see FIG. 18) by wires 126, e.g. a wireline cable which is hardwired to the completion 56. The wireline cable 126 may be coiled inside the completion 56 so that the coil assembly 93 can be pulled out of the lateral completion 56 and into position, as illustrated in FIG. 18. This is accomplished by running in a wireline or coiled tubing fishing tool, which latches onto the fishing head 84 to pull the assembly up into place. Alternatively, the hardware used to run the lateral completion into place can be functionally designed to automatically pull the second coil 68 into position, thus avoiding a separate run into the well.

A variation of the two methods and apparatuses just described allows for the situation when the lateral completion cannot be run fully into the lateral wellbore. Hole cleaning problems, excessive friction, or borehole collapse may prevent the lateral completion 56 from being fully installed into the lateral borehole 54. In this case, a portion of the liner completion may protrude into the mother wellbore 52. This can be a serious problem which would normally require the lateral completion to be retrieved, and the lateral borehole cleaned out with a wiper run. An alternative approach is to have a section of hollow liner or tubing at the top of the lateral completion 56. If the lateral completion 56 cannot be fully inserted into the lateral borehole 54, then a washover drilling bit can be run to cut off the portion that protrudes into the mother wellbore 52. The excess liner is then removed. In the method discussed with reference to FIGS. 10 and 11, if the connection to the extender 88 is below the cut-off location, then the second coil assembly 93 can be run into the well as before. In the method discussed with reference to FIGS. 17 and 18, the liner above the fishing head can be cut-off. Then, the second coil 68 can be pulled into position opposite the milled window 58.

Figure 19:
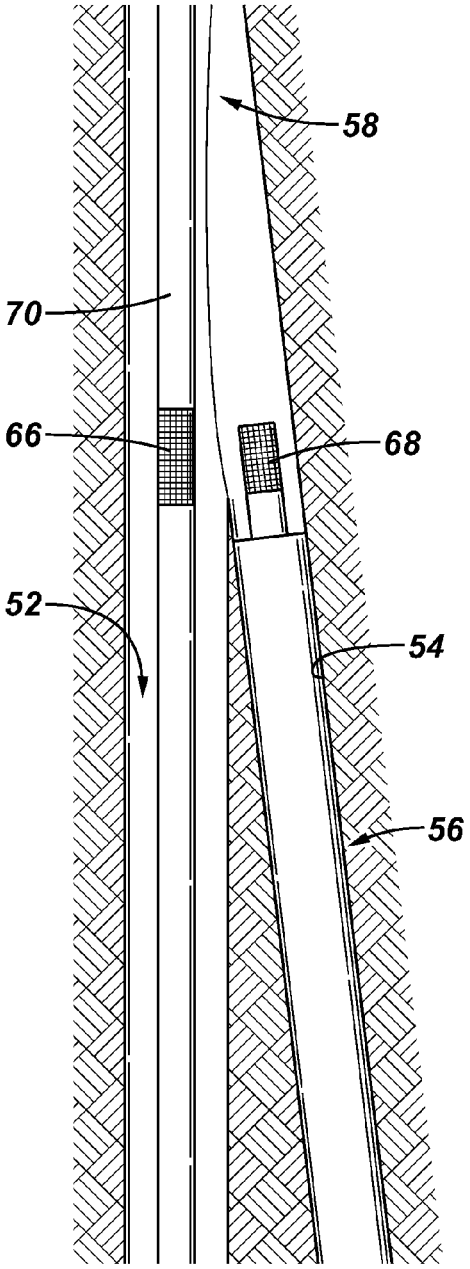
FIG. 19 is a cross-sectional side view of an uncased mother wellbore with a lateral completion placed high, according to another embodiment of the present invention.
Figure 20:
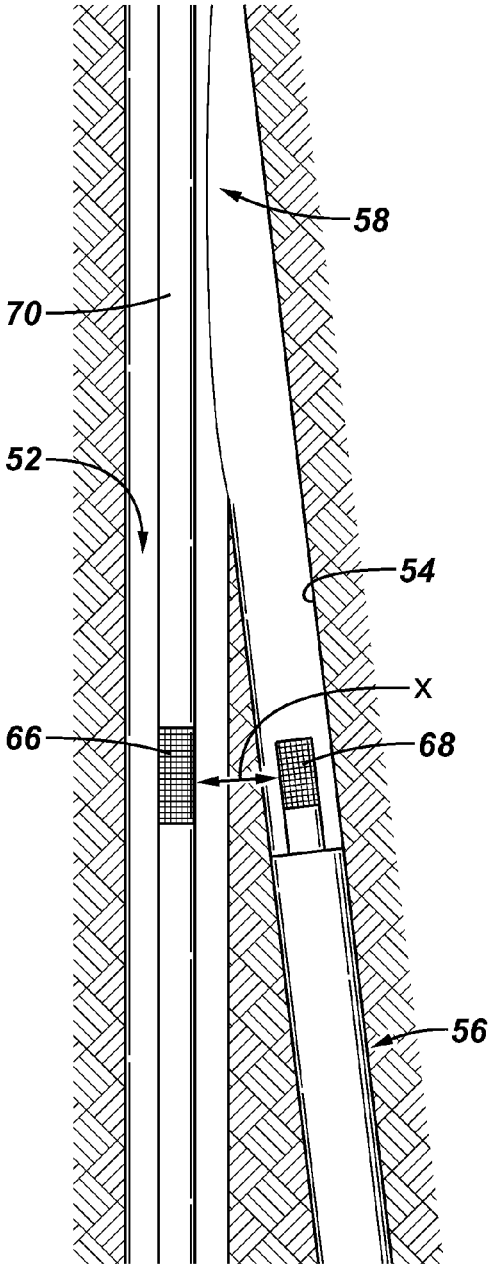
FIG. 20 is a cross-sectional side view of an uncased mother wellbore with a lateral completion placed low, according to another embodiment of the present invention.

When the mother wellbore 52 is not cased, as for a level 1 junction, a different process is followed. The lateral completion 56 may have second coil 68 permanently attached at the top, either on the outside of the completion or slightly above it, as illustrated in FIGS. 19 and 20. After the lateral completion is placed in the well, the height of second coil 68 is measured. The position where first coil 66 is mounted in the mother wellbore, e.g. position on the tubing, is chosen such that the first coil 66 aligns with the second coil 68. Since the initial angle between the mother wellbore 52 and the lateral wellbore 54 is small, the x-distance between the two coils 66, 68 increases slowly with the distance of the lateral completion below the junction. For example, if the second coil 68 is 3 meters below the junction, the distance between the two coils 66, 68 in the x-direction increases only from 26 cm to 36 cm, as illustrated in FIG. 20.

Figure 21:
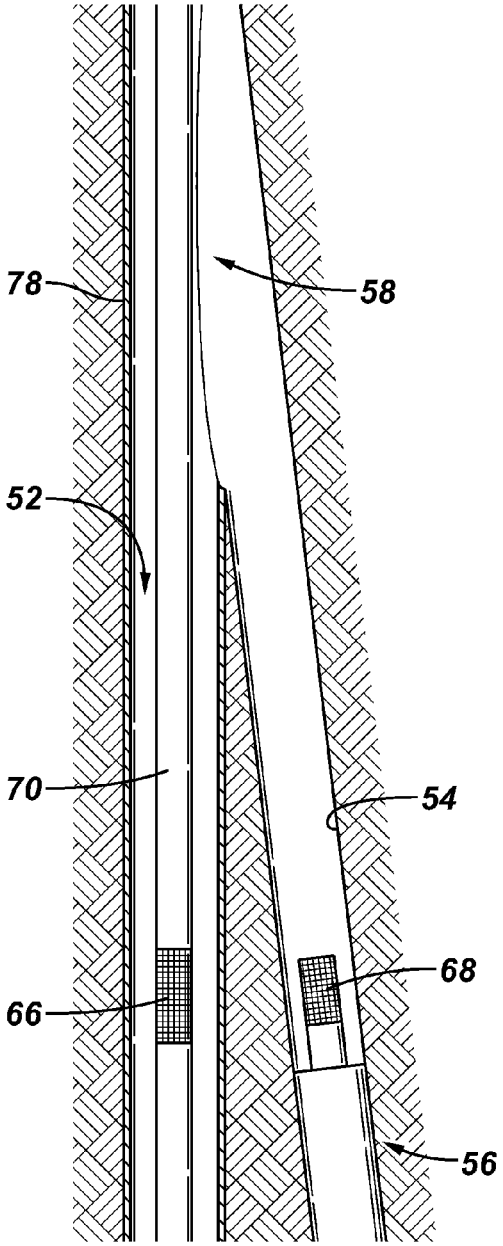
FIG. 21 is a cross-sectional side view of a mother wellbore showing the location of coils, according to another embodiment of the present invention.
Figure 22:
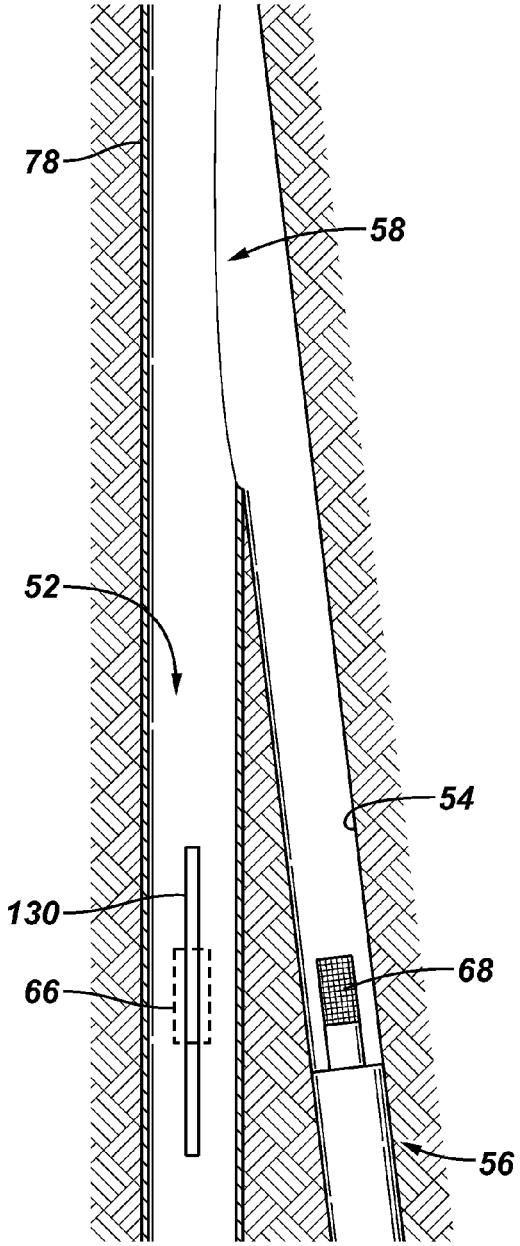
FIG. 22 is a cross-sectional side view of a mother wellbore showing the location of an axial slot in the casing, according to another embodiment of the present invention.

When the mother wellbore 52 is cased, it is possible to permanently attach the second coil 68 to the top of the lateral completion 56. Referring to FIG. 21, the lateral completion 56 is shown located a distance below the milled window 58 in the casing 78. The first coil 66 can be positioned adjacent to the second coil 68 provided there is a slot 130, e.g. an axial slot, in the casing 78 at the location of the two coils 66, 68. In FIG. 22, the axial slot 130 is illustrated as formed through the mother wellbore casing 78. Experiments have shown that an axial slot somewhat longer than the length of the coil allows the magnetic field to penetrate the casing with minimal attenuation. The axial slot can be oriented in any direction, and does not have to face the second coil 68. Hence, the slot 130 may be cut with a mechanical cutter, a chemical cutter, or made with a line of shaped charges (perforation). The slot 130 may be made after the lateral completion 56 has been landed and its position with respect to the milled window 58 has been measured as previously described. Alternatively, if the casing 78 has a pre-milled window and uses a lateral completion that hangs from the mother wellbore casing, then the slot 130 could also be pre-machined into the casing. Once the slot has been made, the first coil 66 can be mounted in the appropriate position on tubing and run into the mother wellbore 52.

Figure 23:
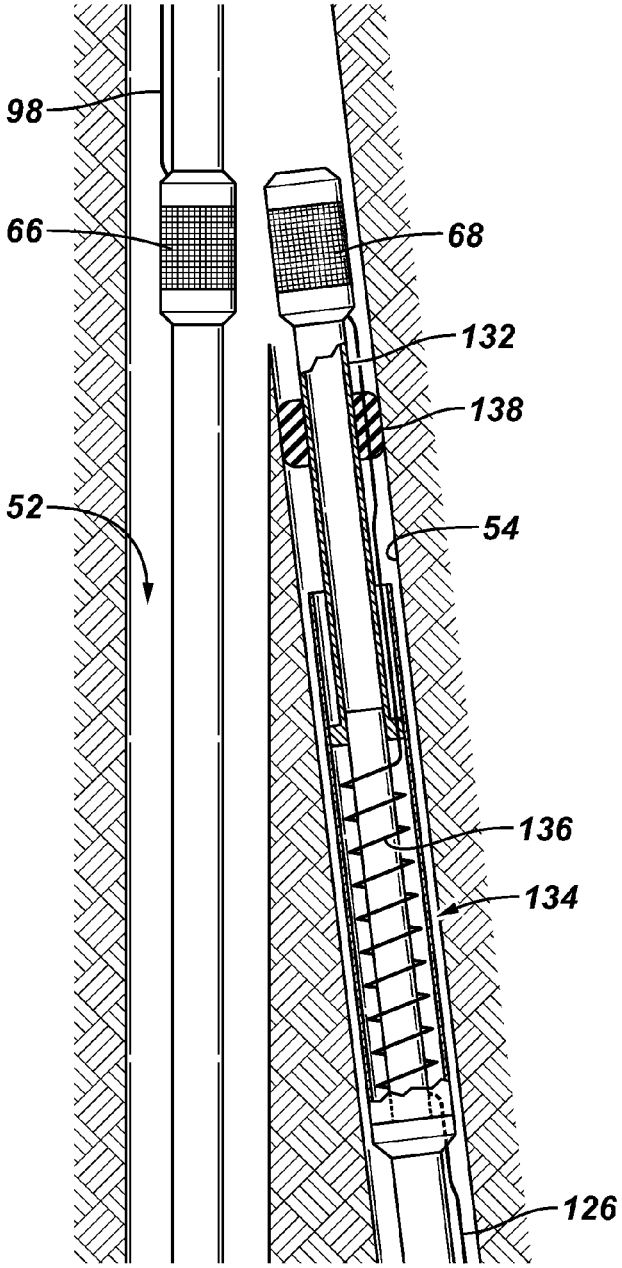
FIG. 23 is a cross-sectional schematic representation of a wired extension joint in the lateral wellbore that allows the externally mounted lateral wellbore coil to be placed in close proximity to the mother wellbore coil, according to another embodiment of the present invention.

Alternatively the second coil 68 may be mounted on the outside diameter of the top of a lateral liner 132, as illustrated in FIG. 23, deployed in the lateral wellbore 54. The length adjustment is obtained using a "wired-extension" joint 134 in which cable 126 is stored inside a spool 136 and withdrawn as needed. This solution can be run in one trip and is based on existing tools such as the wired contraction joint. The wired extension joint solution is complemented with an external casing packer 138 (e.g. inflatable) to hang the upper part of the liner 132 in place. The external casing packer 138 anchors the top of the liner 132 to avoid any axial movement due to gravity or the friction of the fluid flow.

Figure 24:
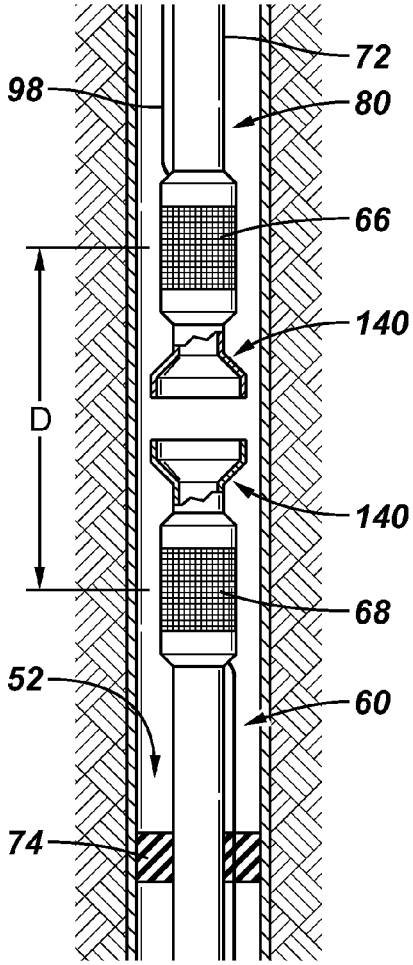
FIG. 24 is a cross-sectional schematic representation of two completions mounted in the same wellbore, according to another embodiment of the present invention.

Two well strings may be placed in the same mother wellbore 52 as previously illustrated in FIGS. 1-5. In these figures, the mother wellbore 52 contains a lower section of completion 60 where production occurs, and an upper section 80 where the lateral wellbores connect to the mother wellbore. The same approach may be used to transmit power from such a lower completion string to another string where both strings are located in the same wellbore. Referring to FIG. 24, one example of this approach is illustrated and provides a system with substantial tolerance of the relative distance D between the first coil 66 located at the bottom of the upper string and the second coil 68 located at the top of the lower completion 60. The acceptable tolerance may be on the order of several feet in length, so there may be no need for a specifically designed mating geometry or a contraction joint otherwise used to adjust the relative distance between the coils. This tolerance in distance is helpful relative to the classical inductive coupling principle which requires extremely close tolerances. In the example illustrated, wireline/tractor reentry guides 140 are connected to the lower completion 60 and the upper completion string 80.

Figure 25:
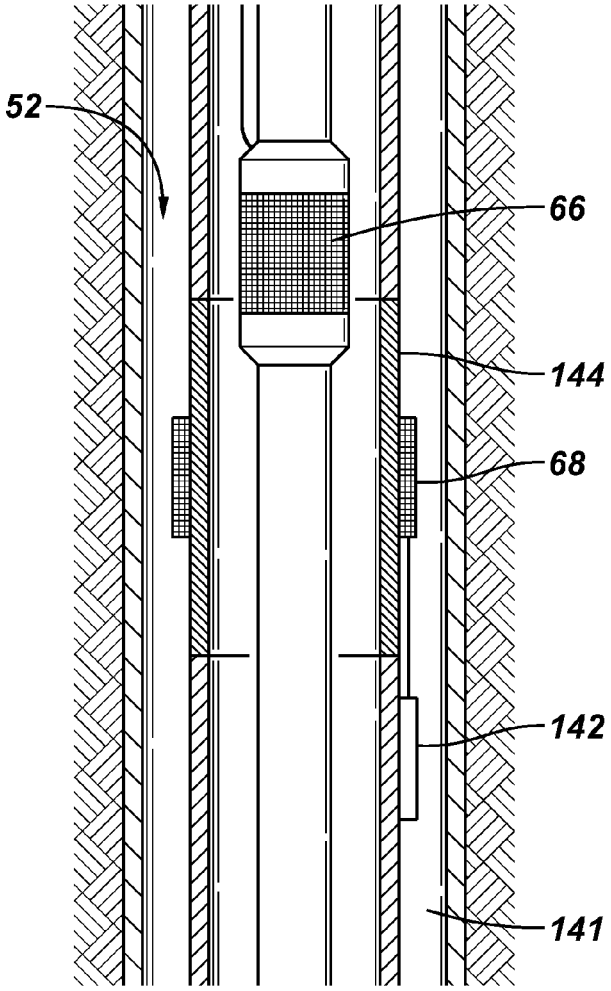
FIG. 25 is a cross-sectional schematic representation of gauges mounted in a B-annulus and powered by a first coil and showing a second coil mounted outside the casing with slots in the casing or mounted on the inner diameter of the casing with a pressure bulkhead, according to another embodiment of the present invention.
Figure 26:
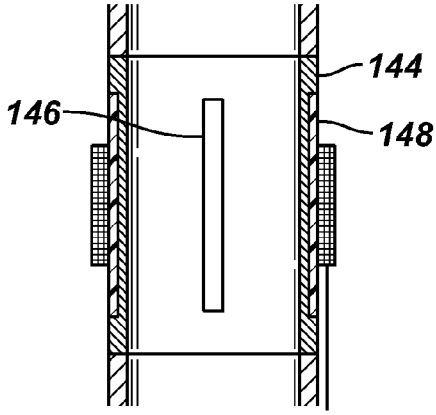
FIG. 26 is a view of a mounting structure for the second coil illustrated in FIG. 25, according to another embodiment of the present invention.
Figure 27:
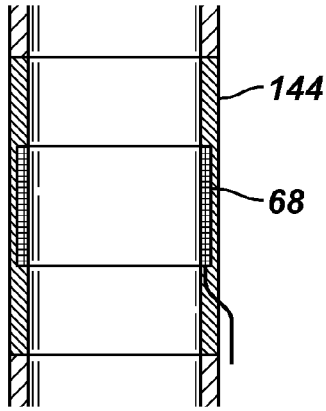
FIG. 27 is a view of an alternate mounting structure for the second coil illustrated in FIG. 25, according to an alternate embodiment of the present invention.

In another embodiment, annulus monitoring may be conducted in which the objective is to monitor the pressure in the "B-annulus" 141 in subsea wells. The B-annulus 141 is located between the production casing and the first intermediate casing as illustrated in FIG. 25. A gauge 142 may be installed in this space but not connected by wires to the surface. Rather the first wireless device 66, e.g. first coil, can be run on tubing with the upper completion to a target depth with sufficient precision, e.g. a few inches to a few feet depending on the depth. The power and telemetry signals are transmitted to (or telemetry from) the gauge 142 through the second wireless device 68 in a special casing sub 144. The special casing sub 144 may have different designs. For example, in a first option, a slot 146 is milled in the metal casing thickness and a non-metallic sleeve 148 is used to contain the pressure in collapse or burst conditions, as illustrated in FIG. 26. In a second option, the second wireless device 68, e.g. second coil, is located on the inner diameter of the sub 144 and connected to the gauge in the B-annulus 141 by wires passing through a pressure bulkhead, as illustrated in FIG. 27.

A variety of other options also may be employed for delivering power to various types of gauges and other devices. For example, another embodiment may comprise a behind-casing pressure gauge, where the apparatus is similar to the above. The pressure gauge is outside the casing and a pressure port is either in direct contact with the formation pressure or in cement. In the latter case, a method to perforate the cement and provide access to the reservoir pressure is employed and a variety of methods may be suitable depending on the specific application and environment. Examples of methods include the use of: shaped charges, chemical degradation of the cement, or an apparatus shape allowing a locally poor cementing (e.g., no fluid removal). Similar to the B-annulus application described above, the first coil 66 is used to transmit power/data to the gauge and to receive measurement data from the gauge. Additionally, the wireless transmission of power and communication signal may be used to trigger the hydraulic communication system though the cement to the reservoir: e.g., to initiate shaped charges or release of a chemical product.

Another alternate embodiment comprises a subsea tree wet connector. The two coils 66, 68 may be used to transmit power between a subsea tree bore and the tubing hanger, which is an alternative to a wet-stab connector, thereby improving reliability and increasing installation efficiency. This could affect about 5% of the downhole instrumentation systems in subsea use. Additionally, the system may not require the use of a spider connector (telescopic connection) to establish the contact. The first coil 66 may be fixed and installed at a certain distance from the final position of second coil 68 which is located in the tubing hanger. Such a system will not require any motion mechanism that is ROV activated, and will reduce the cost of the tree.

Several examples of the well systems utilizing wireless communication are illustrated as implemented with different level junctions in FIGS. 28-35. In the embodiment illustrated in FIG. 28, for example, a portion of one embodiment of multilateral well 50 is illustrated with a level 2 junction. In this embodiment, each first wireless device 66 may comprise an inductive casing coupling installed on production casing in which the window 58 has been pre-milled. The electric line 98 is routed down along the casing for connection to the first wireless device(s) 66. The corresponding second wireless device 68 is positioned in the lateral wellbore 54 at a position sufficiently close such that magnetic field lines 150 are able to convey power and/or data signals wirelessly between the mother wellbore 52 and the lateral wellbore 54. In this particular example, the second wireless device 68 is connected to electrical flow control valves 152 of the lateral completion 56 via an electric line 154. Additionally, the electrical flow control valves 152 may be separated by isolation packers 156, such as swelling packers. Numerous other components, features and deployment techniques may be employed depending on the specific while application.

Figure 28:
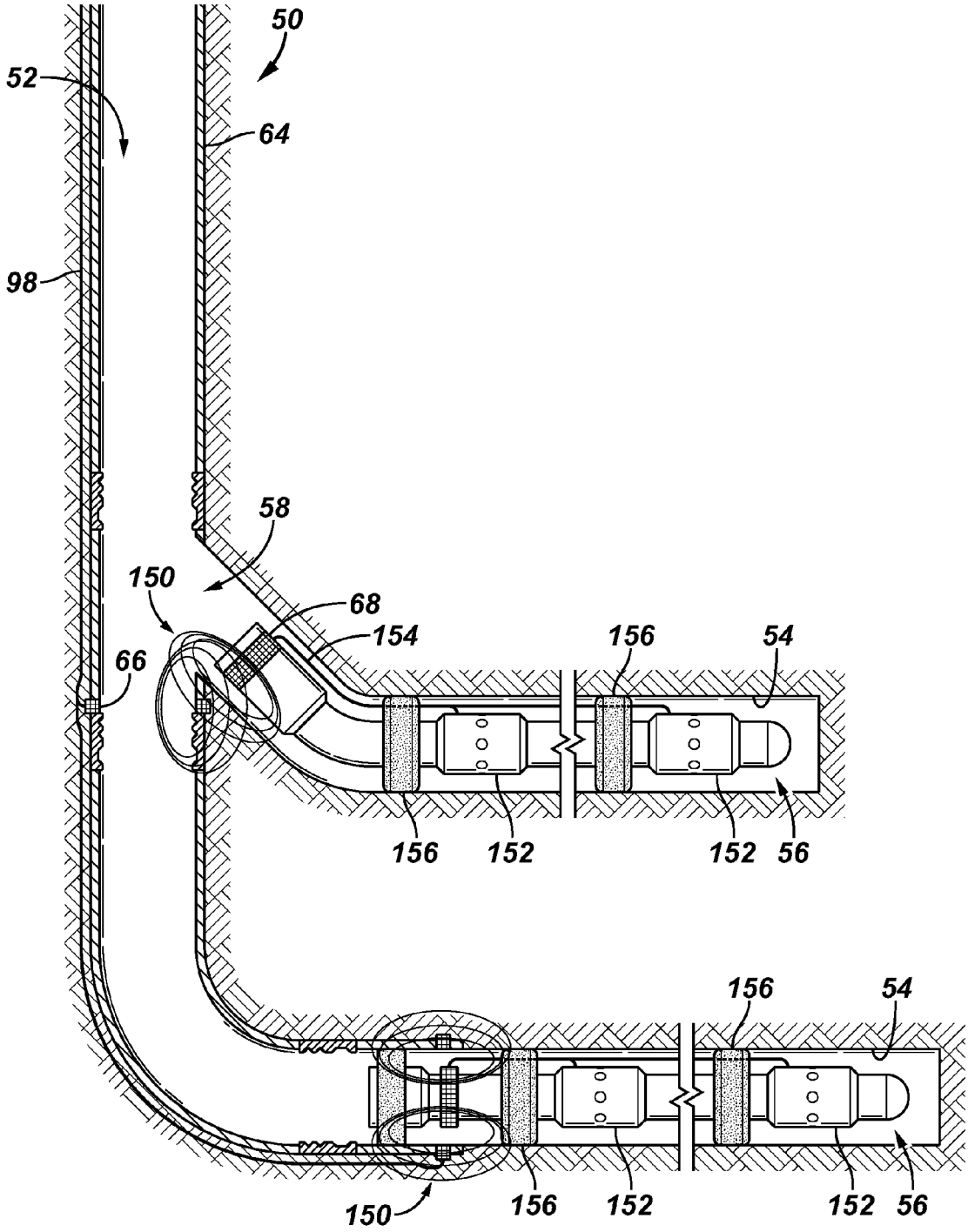
FIG. 28 is a cross-sectional schematic representation of a level 2 junction with a pre-milled window and inductive coupling, according to another embodiment of the present invention.
Figure 29:
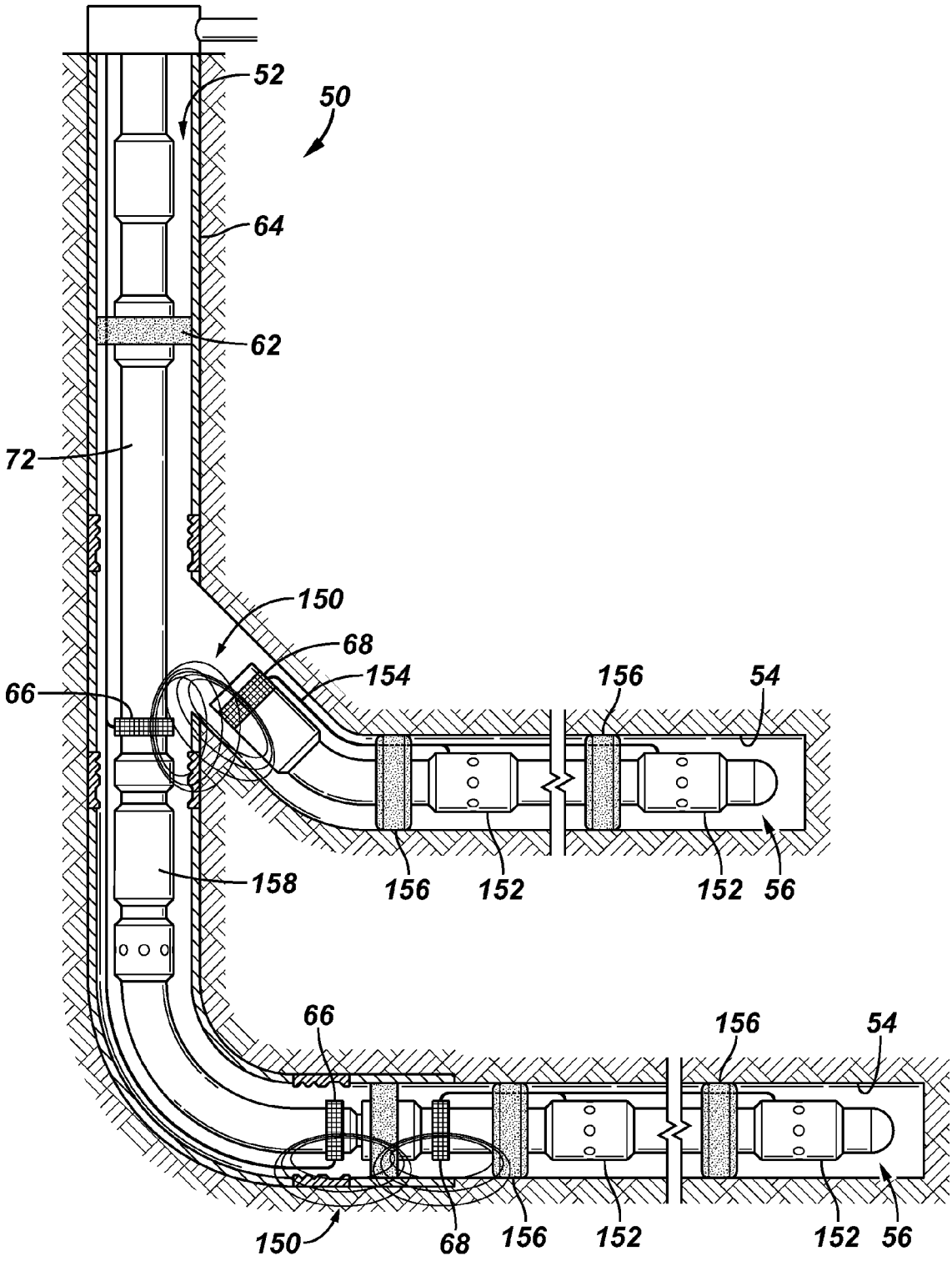
FIG. 29 is a cross-sectional schematic representation of a level 2 junction with a pre-milled window and inductive coupling, according to another embodiment of the present invention.

In FIG. 29, additional components have been added to the multilateral well system illustrated in FIG. 28. For example, the lower lateral completion 56 is connected for wireless communication via wireless devices 66, 68 which are aligned generally linearly. Additionally, a pumping system 158 is illustrated as deployed in the mother wellbore 52 between the lateral wellbores 54 to produce well fluid uphole. As with previously described multilateral well systems, production packer 62 also may be employed in the mother wellbore 52, as illustrated.

Figure 30:
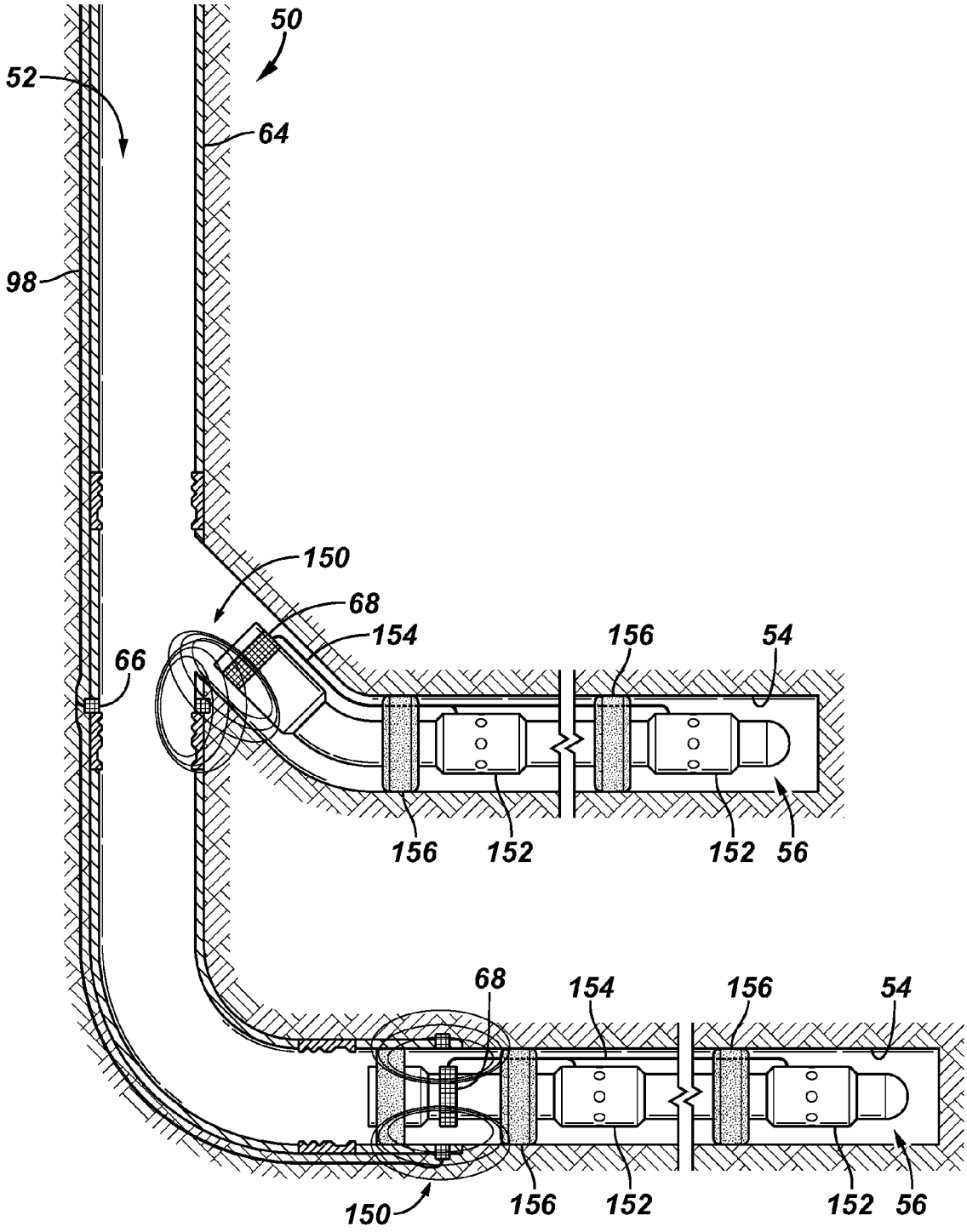
FIG. 30 is a cross-sectional schematic representation of a level 2 junction with a milled window and inductive coupling, according to another embodiment of the present invention.
Figure 31:
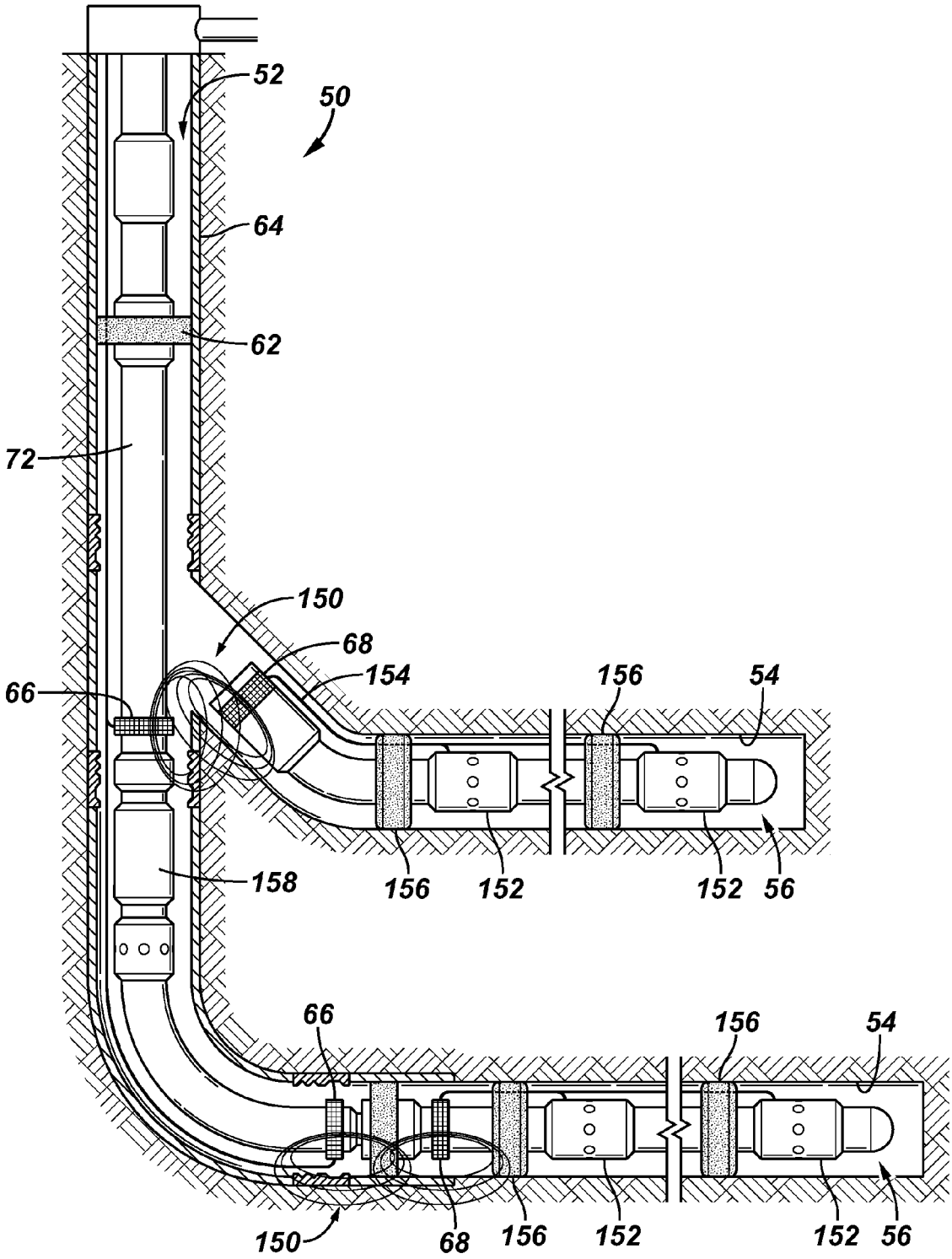
FIG. 31 is a cross-sectional schematic representation of a level 2 junction with a milled window and inductive coupling, according to another embodiment of the present invention.

Referring to FIG. 30, another embodiment very similar to that of FIG. 28 is illustrated. However, the design allows the window 58 to be milled on location with an inductive casing coupling installed on the production casing and the lateral wellbore production liner. In FIG. 31, additional components have been added to the multilateral well system illustrated in FIG. 30. For example, the lower lateral completion 56 is connected for wireless communication via wireless devices 66, 68 which are aligned generally linearly. Pumping system 158 also is illustrated as deployed in the mother wellbore 52 between the lateral wellbores to produce well fluid uphole. As with previously described multilateral well systems, production packer 62 also may be employed in the mother wellbore 52, as illustrated.

Figure 32:
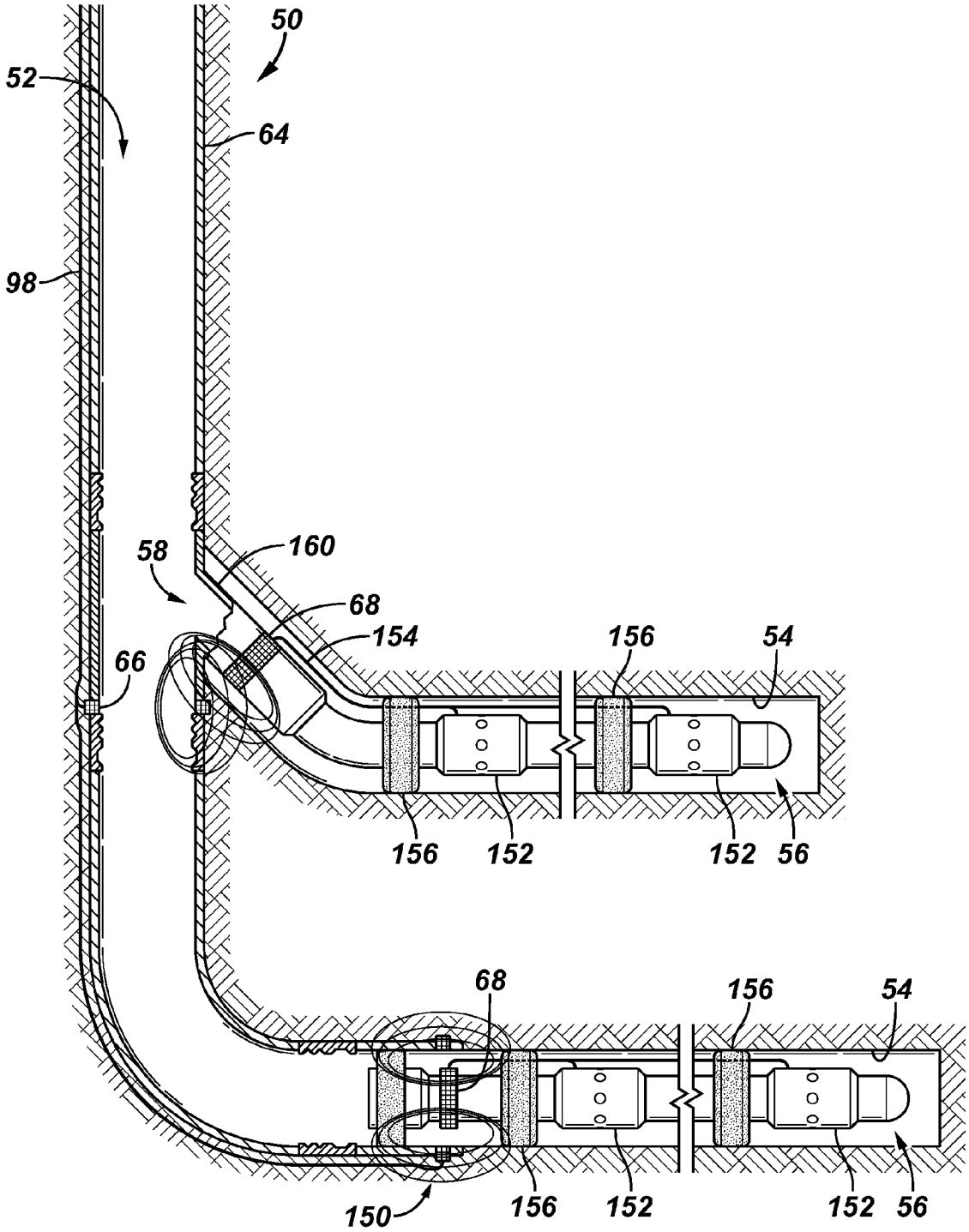
FIG. 32 is a cross-sectional schematic representation of a level 3 junction with a pre-milled window and inductive coupling, according to another embodiment of the present invention.
Figure 33:
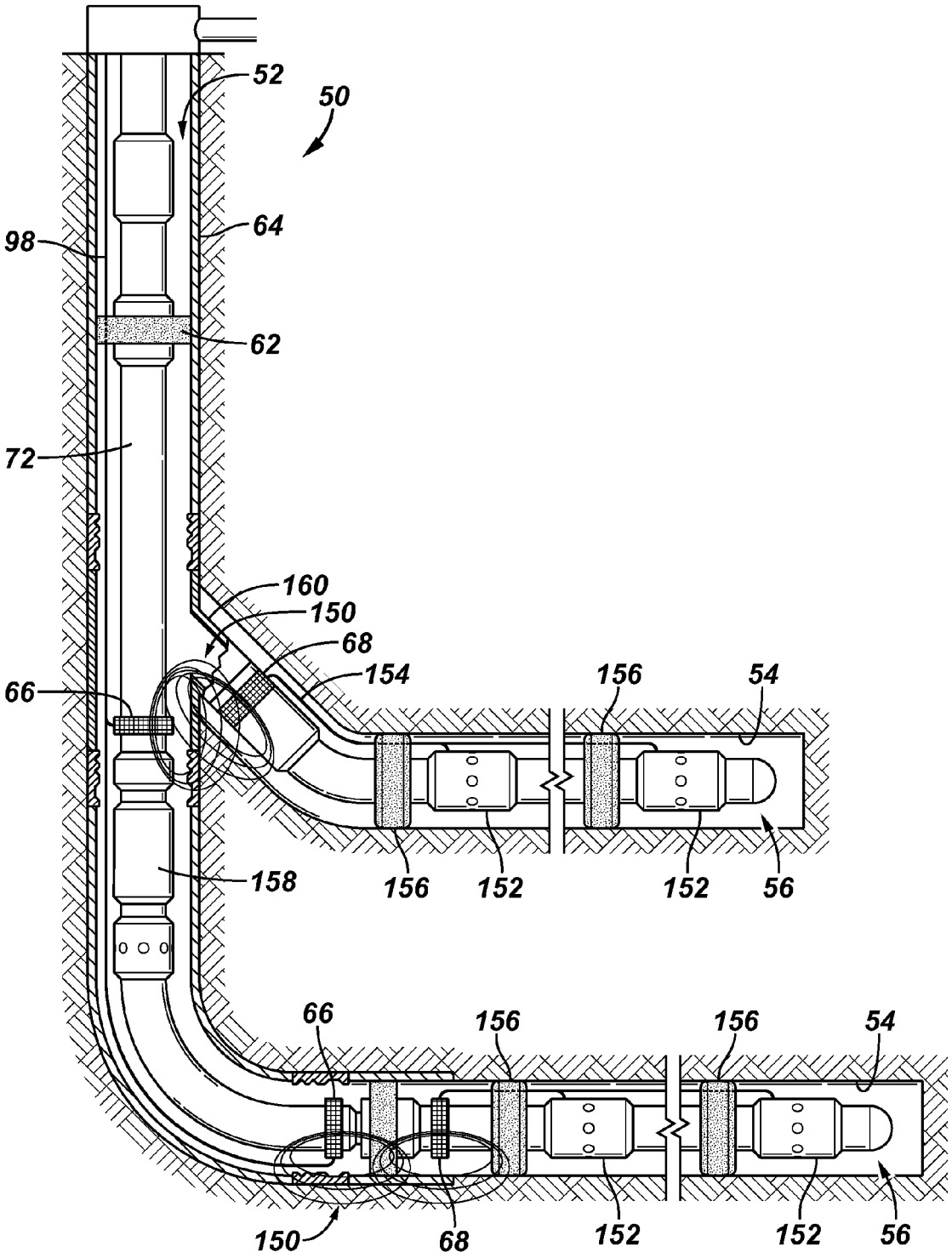
FIG. 33 is a cross-sectional schematic representation of a level 3 junction with a pre-milled window and inductive coupling, according to another embodiment of the present invention.

Referring to FIG. 32, a portion of one embodiment of multilateral well 50 is illustrated with a level 3 junction. This embodiment also similar to the embodiment described above with reference to FIG. 28, however the level 3 junction is formed with a tieback structure 160. The tieback structure 160 extends from the lateral completion 56, at least in the upper lateral wellbore, to the mother wellbore casing 78. At the mother wellbore casing 78, the tieback structure 160 is connected into a pre-milled window 58. In FIG. 33, additional components have been added to the multilateral well system illustrated in FIG. 32. For example, the lower lateral completion 56 is connected for wireless communication via wireless devices 66, 68 which are aligned generally linearly. Pumping system 158 is again illustrated as deployed in the mother wellbore 52 between the lateral wellbores to produce well fluid uphole. As with previously described multilateral well systems, production packer 62 also may be employed in the mother wellbore 52, as illustrated.

Figure 34:
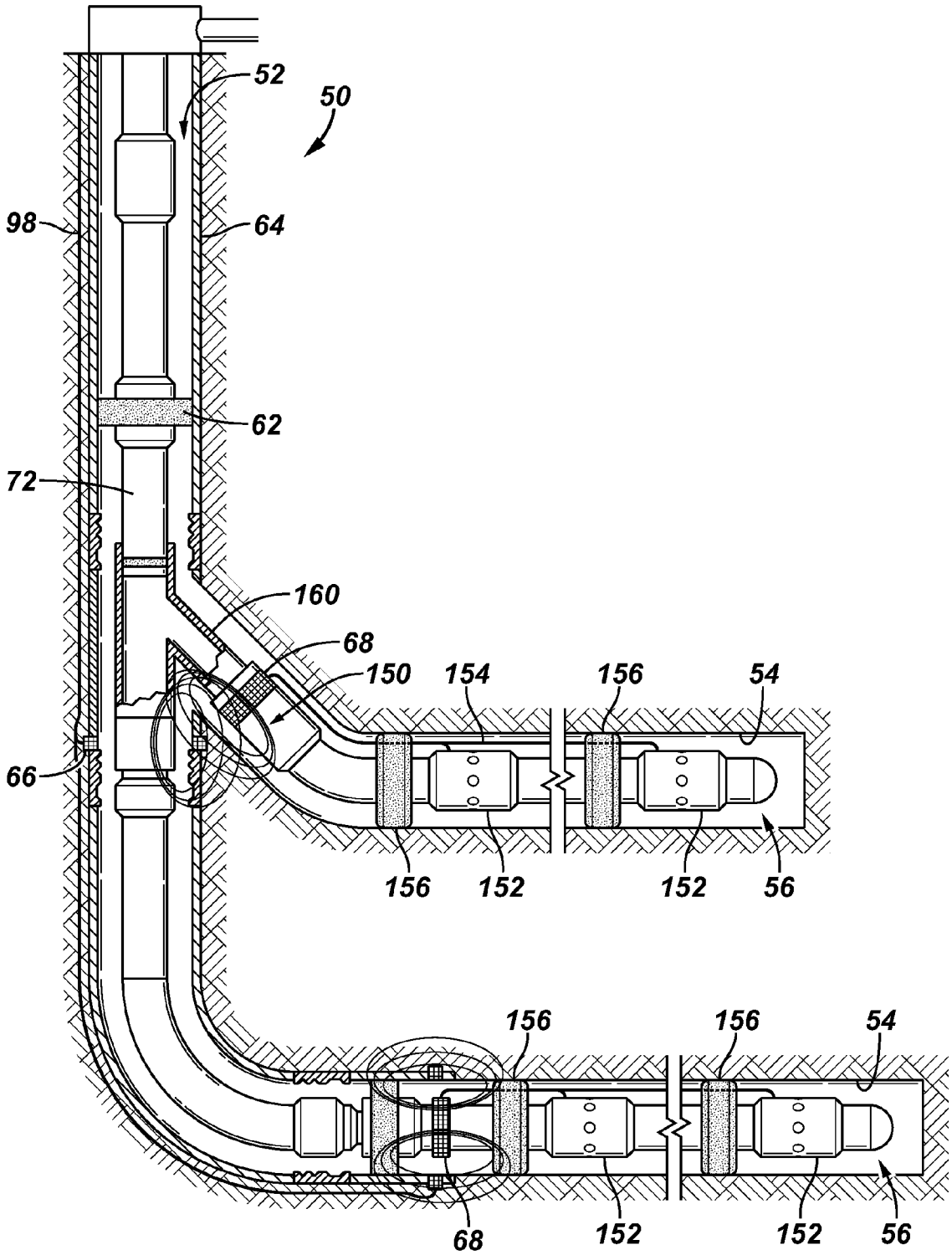
FIG. 34 is a cross-sectional schematic representation of a level 3/5 junction with a milled window and inductive coupling, according to another embodiment of the present invention.
Figure 35:
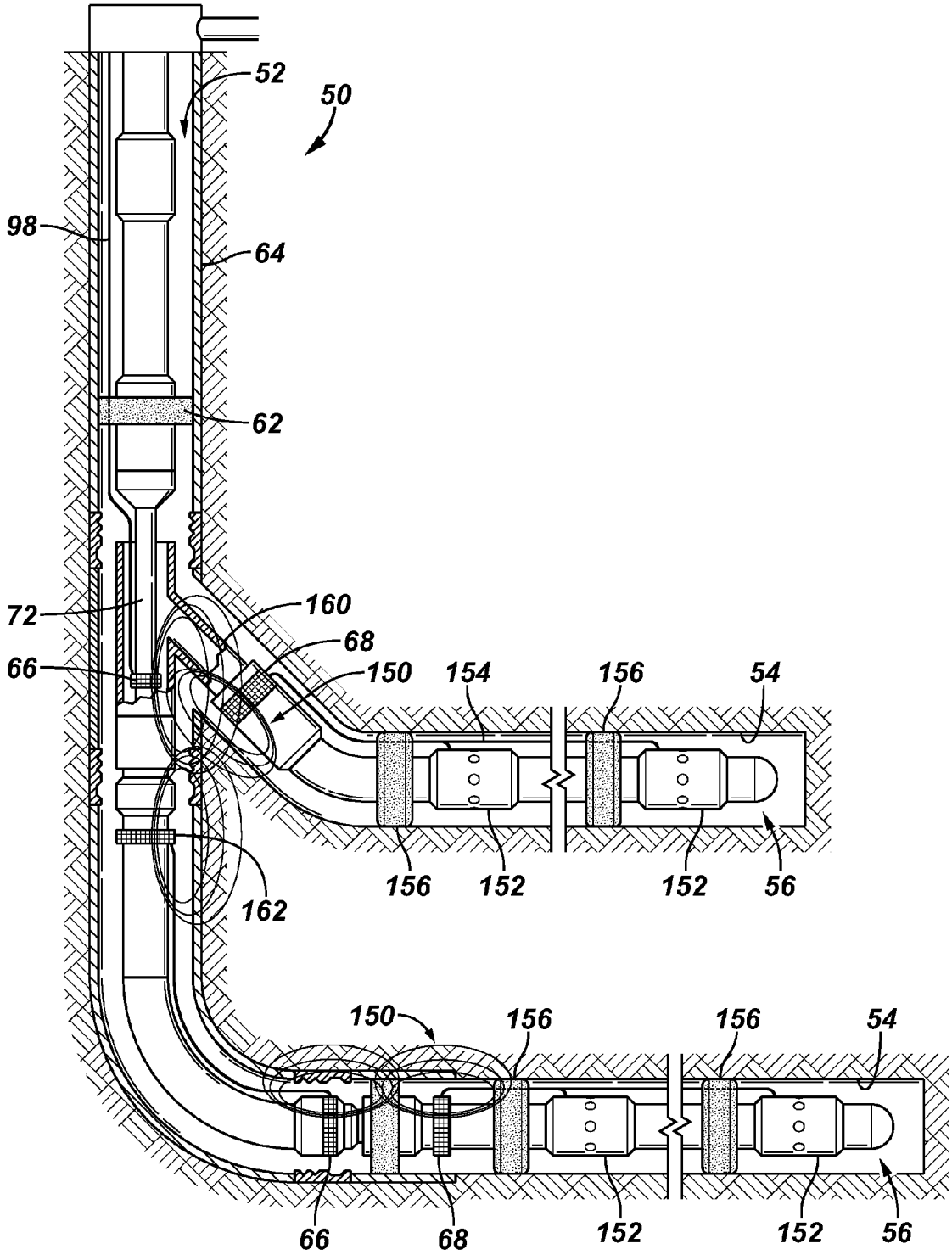
FIG. 35 is a cross-sectional schematic representation of a level 3/5 junction with a milled window and inductive coupling, according to another embodiment of the present invention.

Referring generally to FIG. 34, another embodiment of multilateral well 50 is illustrated with a level 3/5 junction. This embodiment also employs many of the component arrangements illustrated and described above with reference to the embodiment illustrated in FIG. 28. The junctions between the mother wellbore 52 and one or more lateral wellbores 54 may be constructed as level 3/5 junctions that are inductive casing coupling based with window milling to form the opening 58. In this example, first wireless device 66 may be formed with a field emission coupling having a magnetic field line generator. The second wireless device 68 may be formed with a field reception coupling having inducted electric field lines. The embodiment illustrated in FIG. 35 is similar, but it also includes a field reception coupling 162 positioned a distance below window 58, as illustrated. It should be noted the examples illustrated in FIGS. 28-35 are merely a few examples of the components and arrangements that can be utilized in a variety of multilateral well systems employing the wireless communication techniques described herein.

Figure 36:
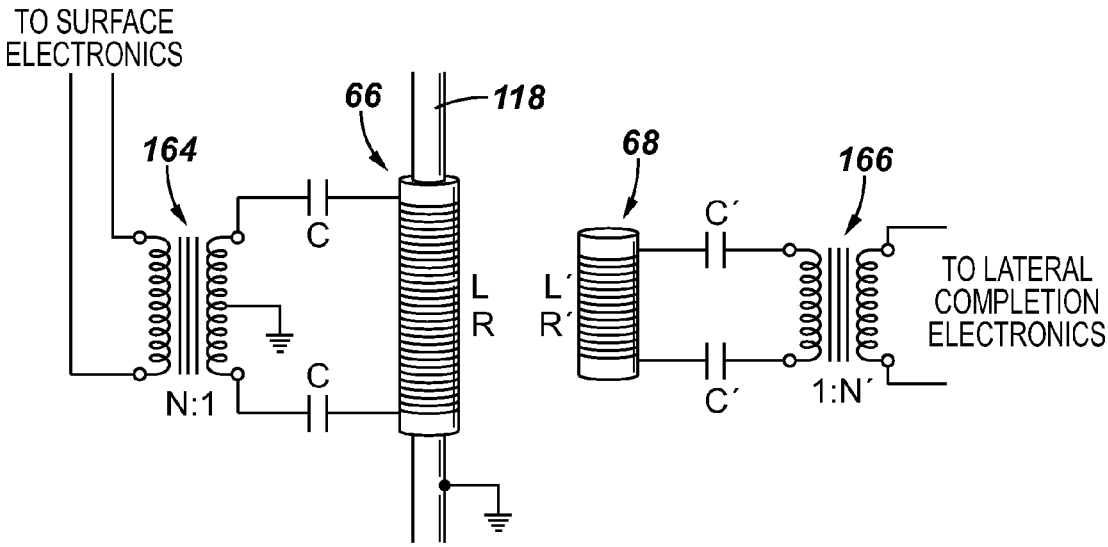
FIG. 36 is a schematic diagram for the circuitry for the first coil and a corresponding second coil, according to another embodiment of the current invention.

With reference to FIG. 36, an explanation of one technique for wireless transfer of power and/or data is provided. In FIG. 36, both wireless devices 66, 68, e.g. both coils, can be characterized as having inductances and series resistance. If the first coil 66 has inductance L and series resistance R, then the impedance of the coil is $R+j\omega L$, where $\omega=2\pi f$ is the angular frequency and where f is the frequency in Hz. Since the coil may have a large inductance, the coil impedance may be very large. By adding series capacitors C, the combined impedance of the first coil 66 and the capacitors is $R+j\{\omega L-2/(\omega C)\}$. The combined impedance has a minimum value (i.e. R) at the resonant angular frequency $\omega_0=\sqrt{2/(LC)}$. At resonance, a balanced to unbalanced transformer (balun) 164 may be used to transform the remaining coil resistance R to match the impedance $Z_0$ of the cables that supply power from the surface. The balun transformer 164 should have a turn ratio N such that $Z_0=N^2R$. This provides optimum efficiency in transferring power from the cables to first coil 66. It may be necessary to adjust the operating frequency to operate at resonance given fixed values of the capacitors, or it may be necessary to adjust the capacitors to achieve resonance at a particular frequency. Similarly, second coil 68 can be described by an inductance L' and a series resistance R'. If the capacitors' on the lateral completion side are chosen such that $C'=2/(\omega_0^2L')$, then second coil 68 will be resonant at the same frequency as first coil 66. The balun transformer 166 on the lateral side should also be chosen to match the impedance of the lateral completion electronics, Z'. If the balun transformer 166 has a turns ratio of N', then N' should be chosen such that $N'=\sqrt{R'/Z'}$.

The optimum power transfer efficiency can be obtained by operating both coils 66, 68 at the same resonant frequency. Similarly, the coils can be used to transfer data by modulating a signal with a carrier frequency at $f_0=\omega_0/(2\pi)$.

In another example, multiple coils may be used to improve the coupling efficiency. For example, several first coils 66 can be attached to the tubing in the mother wellbore 52. These first coils 66 may be activated individually from the surface. The first coil 66 that is closest to a second coil 68 can be located and used for power and telemetry functions. Alternatively, multiple non-axial coils can be employed, and the one providing the most efficient coupling is then used for power and telemetry.

Figure 37:
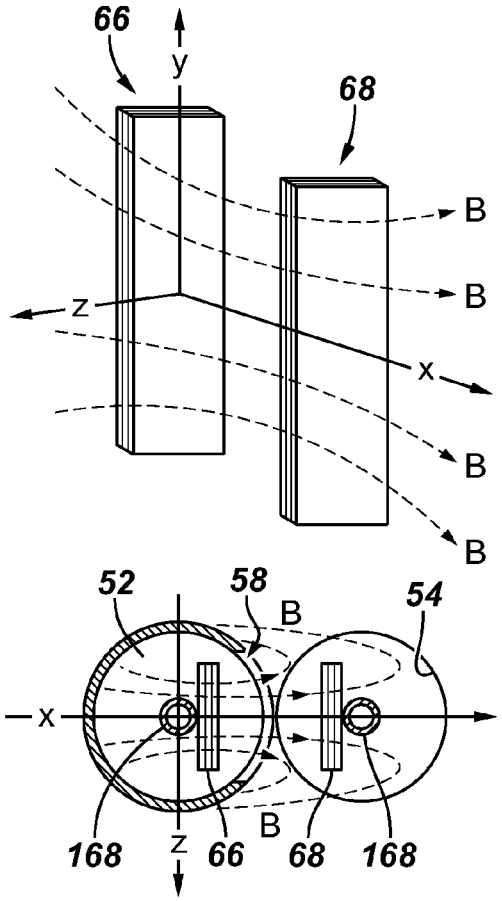
FIG. 37 is a schematic diagram of rectangular coils in the y-z plane, according to another embodiment of the current invention.
Figure 38:
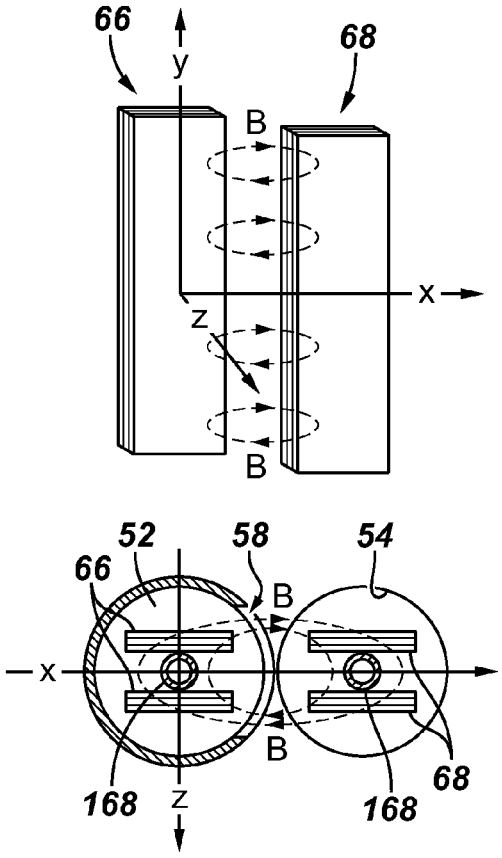
FIG. 38 is a schematic diagram of rectangular coils in the y-z plane, according to another embodiment of the current invention.

In some of the embodiments described so far, the two coils 66, 68 have been presented as axial, such as in the embodiments illustrated in FIGS. 8, 9, 15, 16, 36, among others. However, this representation should not be considered limiting. For example, it is also possible to use non-axial coils as shown in FIGS. 37 and 38. As illustrated by these embodiments, the coils 66, 68 may be rectangular and mounted on small diameter tubing 168 in some cases. Also, the mother wellbore 52 may be cased and the lateral wellbore 54 uncased. The y-axis is aligned with the mother borehole axis, and the x-axis connects the center of the mother wellbore with the center of the lateral wellbore.

In FIG. 37, both coils 66, 68 lie in planes parallel to the y and z axes. The first coil 66 produces a magnetic field B which initially points in the x-direction. The x-component of this magnetic field induces an EMF in second coil 68. In the embodiment illustrated in FIG. 38, the coils 66, 68 also are rectangular and lie in planes parallel to the x and y axes. The first coil 66 produces a magnetic field B which initially points in the z-direction. The z-component of this magnetic field induces an EMF in the second coil 68. For each of these cases, the two coils 66, 68 should be oriented similarly for maximum coupling.

While the invention has been disclosed with respect to a limited number of embodiments, many variations are possible. For example, the wireless power and/or data communication techniques may be employed within a single borehole, such as the mother borehole, or between a mother wellbore and a substantial number of lateral wellbores. The wireless communication devices 66, 68 may comprise coils or other components which induce or otherwise cause wireless transmission of the desired signals. Furthermore, the lateral completions as well as the one or more completions deployed in the mother wellbore may have many different types of components designed for production applications, servicing applications, and a wide variety of other well related applications. Additionally, many types of powered devices may be employed in the lateral wellbores to receive power via the wireless transmission. Similarly, the devices may receive and/or output data, e.g. telemetry data, which is transmitted wirelessly via wireless devices 66, 68. The transmission of power and/or telemetry data may be adjusted as desired for a given application in a given environment. For example, a telemetry only embodiment may be configured for a situation in which power for the electronics tools in the lateral is produced locally or comes from a battery in the lateral. A telemetry only embodiment may be similar to previously described embodiments but used to only transmit data.

Although only a few embodiments of the present invention have been described in detail above, those of ordinary skill in the art will readily appreciate that many modifications are possible without materially departing from the teachings of this invention. Accordingly, such modifications are intended to be included within the scope of this invention as defined in the claims.

What is claimed is:

1. A system for transferring power wirelessly in a well, comprising:

a first coil positioned in a mother wellbore component; and;

a second coil positioned in a lateral completion component located in a lateral wellbore, the second coil being positioned proximate the first coil when the lateral completion component receives the mother wellbore component in a male-female relationship; therein, wherein power is transferred between the first and second coils via magnetic fields between the first and second coils, further wherein the first coil and the second coil are disposed on opposite sides of a tubing wall with respect to each other and an opening is formed in the tubing wall to facilitate penetration by the magnetic fields.

2. The system as recited in claim 1, wherein the first coil is mounted on a carrier deployed downhole in a mother wellbore.

3. The system as recited in claim 1, wherein the first coil is mounted on a tubing deployed downhole in a mother wellbore.

4. The system as recited in claim 1, wherein the second coil is mounted on an extender having a length selected to enable placement of the second coil into proximity with the first coil while downhole.

5. The system as recited in claim 1, wherein the opening comprises a slot formed in a casing.

6. A method for facilitating a transfer of power or data in at least one lateral wellbore, comprising:

providing a first coil in a mother wellbore component;

providing a second coil in a lateral completion component located in a lateral wellbore;

positioning the first coil proximate to the second coil by engaging the mother wellbore component and the lateral completion component in a male-female relationship; and communicating signals through a slot in the mother wellbore component via magnetic fields between the coils.

7. The method as recited in claim 6, further comprising transferring power to a gauge via the magnetic fields between coils.

8. A method, comprising:

positioning a wireless device in a lateral completion located in a lateral wellbore;

locating a corresponding wireless device in a corresponding mother wellbore component comprising a tubing;

linearly moving the corresponding mother wellbore component and the corresponding wireless device into proximity with the lateral completion in a male-female relationship; and enhancing communication between the corresponding wireless device and the wireless device by forming an opening in the tubing between the corresponding wireless device and the wireless device; and transferring power wirelessly between the corresponding wireless device and the wireless device.

9. The method as recited in claim 8, further comprising transferring telemetry data between the corresponding wireless device and the wireless device.

10. The method as recited in claim 8, wherein positioning comprises positioning a plurality of the wireless devices in a plurality of lateral wellbores which extend from a mother wellbore.

11. The method as recited in claim 8, wherein transferring comprises transferring power wirelessly from a position within a casing to a position external to the casing.

12. The method as recited in claim 8, wherein positioning the wireless device comprises positioning a coil; and locating the corresponding wireless device comprises locating a corresponding coil.

13. A system, comprising:

a plurality of wireless devices positioned in a plurality of lateral wellbores;

a plurality of corresponding wireless devices each corresponding wireless device being paired with one of the wireless devices positioned in one of the lateral wellbores; and a power supply line coupled to the corresponding wireless devices to deliver electrical power to the plurality of corresponding wireless devices, wherein the electrical power is transferred wirelessly to the plurality of wireless devices positioned in the plurality of lateral wellbores, wherein at least one of the wireless devices is located in a lateral completion and at least one of the corresponding wireless devices is located in a mother wellbore component linearly received in a male-female engagement by the lateral completion, further wherein communication between wireless devices and corresponding wireless devices is enhanced by placing an opening in a component disposed between each wireless device and each corresponding wireless device.

14. The system as recited in claim 13, wherein the plurality of wireless devices comprises a plurality of wireless coils; and the plurality of corresponding wireless devices comprises a plurality of corresponding coils.

15. The system as recited in claim 14, wherein the plurality of wireless coils transfers telemetry data wirelessly to the plurality of corresponding wireless coils.

* * * * *